United States Patent [19]

Flautt, Jr. et al.

[11] 4,268,738

[45] May 19, 1981

[54] MICROWAVE ENERGY MODERATOR

[75] Inventors: Thomas J. Flautt, Jr.; Edward J. Maguire, Jr.; David L. Richardson, all of Cincinnati, Ohio

[73] Assignee: The Procter & Gamble Company, Cincinnati, Ohio

[21] Appl. No.: 854,941

[22] Filed: Nov. 25, 1977

Related U.S. Application Data

[63] Continuation-in-part of Ser. No. 837,074, Sep. 28, 1977, abandoned, which is a continuation-in-part of Ser. No. 821,934, Aug. 4, 1977, abandoned.

[51] Int. Cl.[3] ..... H05B 6/80; A21D 10/02

[52] U.S. Cl. ..... 219/10.55 F; 219/10.55 E; 426/107; 426/243

[58] Field of Search ..... 219/10.55 F, 10.55 E, 219/10.55 R, 10.55 D, 10.55 M; 426/107, 109, 241, 243; 174/35 MS; 206/432, 484.2, 497; 53/127; 126/261; 229/3.5 MF; 220/450

[56] References Cited

U.S. PATENT DOCUMENTS

| | | | |
|---|---|---|---|
| 2,633,284 | 3/1953 | Moffett et al. . | |
| 3,042,532 | 7/1962 | Daline . | |
| 3,188,215 | 6/1965 | Snow, Jr. . | |
| 3,219,460 | 11/1965 | Brown | 219/10.55 E |
| 3,271,169 | 9/1966 | Baker et al. | 219/10.55 E X |
| 3,271,552 | 9/1966 | Krajewski | 219/10.55 E |
| 3,410,700 | 11/1968 | Gstohl | 426/107 |
| 3,428,772 | 2/1969 | Wallenfels | 219/10.55 F |
| 3,461,260 | 8/1969 | Bremer | 219/10.55 F |
| 3,547,661 | 12/1970 | Stevenson . | |
| 3,572,499 | 3/1971 | Mondano | 174/35 MS X |
| 3,672,916 | 6/1972 | Virnig | 426/107 |
| 3,819,900 | 6/1974 | Ironfield | 219/10.55 F |
| 3,835,281 | 9/1974 | Mannix | 219/10.55 E |
| 3,865,301 | 2/1975 | Pothier et al. | 219/10.55 E X |
| 3,985,992 | 10/1976 | Goltsos | 219/10.55 E |
| 4,008,383 | 2/1977 | Tanaka et al. | 219/10.55 D |
| 4,013,798 | 3/1977 | Goltsos | 219/10.55 E |
| 4,015,085 | 3/1977 | Woods | 219/10.55 E |
| 4,027,132 | 5/1977 | Levinson | 219/10.55 F |
| 4,037,009 | 7/1977 | Severinsen | 174/35 MS X |
| 4,080,524 | 3/1978 | Greenfield, Jr. et al. | 219/10.55 E |
| 4,081,646 | 3/1978 | Goltsos | 219/10.55 E |
| 4,115,680 | 9/1978 | Moore | 219/10.55 E X |
| 4,122,324 | 10/1978 | Falk | 219/10.55 E |
| 4,132,811 | 1/1979 | Standing et al. | 219/10.55 E X |
| 4,133,896 | 1/1979 | Standing et al. | 219/10.55 E |

*Primary Examiner*—Arthur T. Grimley
*Attorney, Agent, or Firm*—Thomas J. Slone; John V. Gorman; Richard C. Witte

[57] ABSTRACT

A microwave moderator for partially attenuating and/or modifying microwave energy to achieve, for instance, more uniform cooking of comestible articles in microwave ovens. Packages, bags, and wraps are disclosed which comprise such microwave moderators and which enable microwave cooking of frozen foods at relatively high microwave oven power levels without requiring precooking, defrosting or oven power level changes. Such a moderator may comprise an array of alternately disposed or spaced areas of microwave reflective material, and complemental-shape, substantially microwave transparent zones. One species of such moderators is exemplified by a wrap which comprises a perforate sheet of microwave reflective material; for instance, aluminum foil. In embodiments comprising such a perforate sheet, the perforate sheet is provided with a plurality of generally uniformly spaced apertures which are sufficiently large with respect to the wavelength of the microwave energy that a substantial portion of such microwave energy directed at said moderator will pass therethrough. The moderator may also include a sheet of microwave transparent, moisture barrier material such as thermoplastic film which is selectively foraminous or perforated to control the passage of vapor (for venting) and liquids (for draining) through the moderator. A dynamic, temperature responsive microwave moderator is also disclosed which will change from being relatively transparent to microwave energy or having a predetermined degree of microwave energy transmissibility to being substantially less transparent or substantially opaque to microwave energy or to having a substantially diminished degree of microwave energy transmissibility when heated to or above a predetermined temperature.

24 Claims, 48 Drawing Figures

Fig. 1
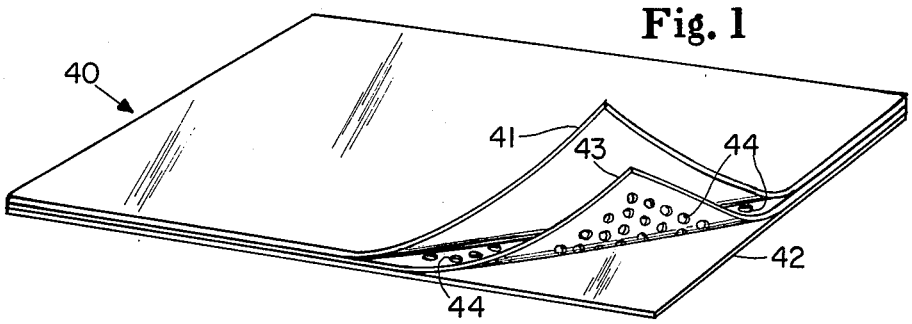
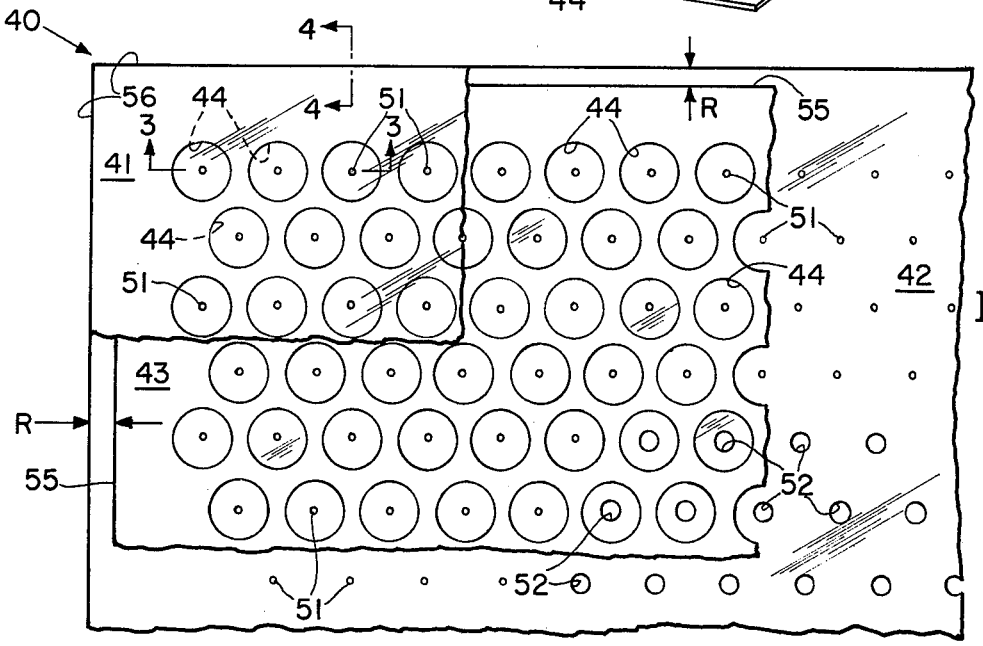
Fig. 2
Fig. 3
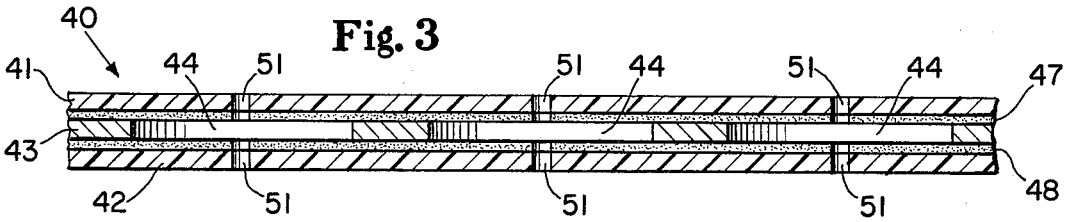
Fig. 5
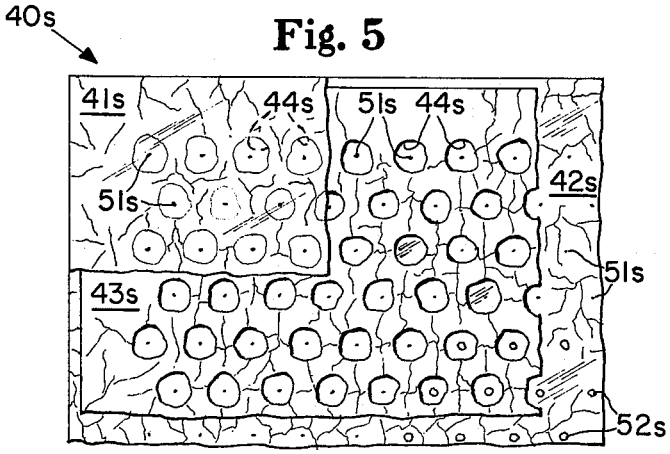
Fig. 4
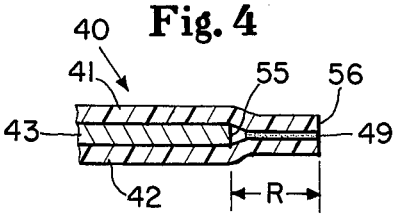

MICROWAVE OVEN COOKED
BEEF ROASTS
1000 GRAM NOMINAL WEIGHTS

MICROWAVE OVEN HEATED
WATER
40 CC NOMINAL VOLUMES

MICROWAVE OVEN HEATED
WATER
40 CC NOMINAL VOLUMES

MICROWAVE ENERGY MODERATOR

CROSS-REFERENCE TO RELATED APPLICATION

This application is a continuation-in-part of the commonly assigned, co-pending continuation-in-part application Ser. No. 837,074, filed on Sept. 28, 1977, now abandoned which is a continuation-in-part of Ser. No. 821,934, abandoned Aug. 4, 1977.

FIELD OF THE INVENTION

The present invention pertains, in general, to providing means for moderating a field of microwave energy: for instance, providing means for sufficiently enclosing and shielding comestible articles to be cooked in microwave ovens so that uniform cooking results. The present invention also pertains to providing means for obviating the excessive loss of constituents as water, fat, flavor, aromatics, and the like during microwave cooking. The invention still further pertains to providing means for reducing the criticality of timing microwave cooking as well as reducing the attention and activity associated with conventional microwave cooking. More particularly, the present invention enables cooking frozen foods in microwave ovens without having to initially thaw the food and/or without having to provide power level changes to sequentially effect thawing and then cooking.

BACKGROUND OF THE INVENTION

Conventional microwave oven cooking generally involves having to periodically reposition an article being cooked and/or to adjust the oven power to lessen uneven cooking; or excessive weight loss and concomitant dryness of the article being cooked; or criticality of timing the cooking interval; or having to cook a plurality of articles (e.g.: meal components such as potatoes, vegetables, and meat) sequentially rather than simultaneously. Moreover, because frozen foods are much less effective than unfrozen foods with respect to converting microwave energy to heat, the cooking of frozen foods in microwave ovens conventionally requires either pre-cooking thawing and/or relatively elaborate control of and changes of microwave power. That is, low power or periodic power ON intervals to effect thawing, and relatively high continuous power to effect cooking.

With respect to addressing the problem of uneven cooking in microwave ovens, rotating mode stirrers have been provided to lessen non-uniformity of the field of microwave energy in microwave ovens, and rotating shelves have been introduced to lessen the effects of non-uniform fields of microwave energy in microwave ovens. U.S. Pat. No. 3,819,900 which issued June 15, 1974 to Richard Ironfield discloses such a rotating mode stirrer and U.S. Pat. No. 3,428,772 which issued Feb. 18, 1969 to K. H. Wallenfels discloses such a rotating shelf.

The prior art further discloses a number of microwave cooking containers and the like which comprise selective shielding and/or microwave transparent apertures of various sizes in structures that are otherwise microwave reflective. For instance, U.S. Pat. No. 3,547,661 which issued Dec. 15, 1970 to P. N. Stevenson discloses a container and food heating method wherein apertures of various sizes are provided in the top and bottom and are in registered relation. Such apertures may also be partially masked by microwave reflective material as indicated in FIGS. 1 and 3, areas 25 through 28. The various sizes of apertures and partial masking ostensibly provide means for selectively heating different items to different temperatures simultaneously; reference Abstract Of The Disclosure. However, this patent teaches away from the present invention by stating that areas of cross hatched lines of aluminum with intermediate spaces of equal width will pass half the radiation; reference column 3, lines 17–21 inclusive. In fact, relatively small cross hatching will substantially obviate transmission of microwave energy (consider for example, the small holes in the shield component of the door of a microwave oven), and relatively large cross hatching will be substantially ineffective with respect to blocking radiation. U.S. Pat. No. 4,013,798 which issued Mar. 22, 1977 to Costas E. Goltsos also discloses a selectively shielded microware cooking structure comprising registered openings of various sizes.

The contemporary use of apertures of various sizes and/or shapes which are disposed in the top of a microwave cooking food tray which is otherwise microwave reflective are disclosed in U.S. Pat. No. 3,672,916 which issued June 27, 1972 to H. J. Virnig, and in U.S. Pat. No. 3,219,460, which issued Nov. 23, 1965 to E. Brown.

Prior art means for venting and/or selectively venting microwave cooking trays and packages are disclosed by Goltsos and Virnig which are referenced above, and by U.S. Pat. No. 2,633,284 which issued Mar. 31, 1953 to H. J. Moffett et al, and U.S. Pat. No. 3,188,215 which issued June 8, 1965 to W. T. Snow, Jr. Goltsos' package is vented by rupturing weakened areas with water vapor pressure; Virnig and Snow provide venting through the use of heat retractible membranes such as heat shrinkable thermoplastic; and Moffett et al provide venting through the use of meltable plugs. Also, U.S. Pat. No. 4,027,132 which issued May 31, 1977 to Melvin L. Levinson discloses selectively shielded pie baking utensils which comprise microwave reflective elements (e.g., cover 6 and plate 17) having steam/vapor passageways through them.

Prior art in the field of cooking wraps includes, for instance U.S. Pat. No. 3,042,532 which issued July 3, 1962 to G. Daline. Daline discloses a wrapper having spaced recesses filled with seasoning and which may be perforated to enable seasoning mobility and/or venting. However, it is believed that the wrap is not identified as comprising microwave reflective materials and having microwave transparent zones such as are included in the present invention.

Further, with respect to wraps, a cookbook entitled "Variable Power Microwave Cooking From Litton" (Copyrighted in 1975 by Litton Systems, Inc.) suggests on page 9 that small pieces of aluminum foil can be used to cover spots on large pieces of meat which appear to be overcooking. That is, such foil can be applied during the cooking interval to selectively shield done portions of a large piece of roast.

Additionally, while it is not believed to be prior art with respect to this invention, R. V. Decareau, Ph.D., has disclosed that perforated end caps can be used to protect the ends of otherwise unshielded, relatively long cylindrical roasts from overcooking in a microwave oven; Reference 1977 International Microwave Power Symposium Summaries, Minneapolis, Minnesota, May 24–27, 1977.

To summarize the prior art, some of the problems associated with microwave cooking have been solved in part by prior art developments. However, it is believed that the prior art has not addressed providing means such as the microwave moderators of the present invention for moderating the rate of cooking during the course of cooking, and/or moderating the microwave energy field to make it more uniform inside an enclosure containing the matter to be cooked, and has not solved the problems of microwave cooking to the same extent nor to the same degree as provided by the present invention. That is, by providing both static and dynamic microwave energy moderators, and bags, wraps, vessels, oven liners, and packages comprising such moderators which facilitate more uniform cooking with reduced attention, retaining more weight, and rendering microwave cooking less dependent on precisely timing cooking intervals.

OBJECTS OF THE INVENTION

The nature and substance of the invention will be more readily appreciated after giving consideration to its major aims and purposes. The principal objects of the invention are recited in the ensuing paragraphs in order to provide a better appreciation of its important aspects prior to describing the details of a preferred embodiment in later portions of this description.

A major object of the present invention is providing a microwave energy moderator which will, in effect, when disposed in a path of microwave energy, provide a substantially more uniform microwave energy field downstream from the moderator than the uniformity of the field would be absent the moderator.

An additional major object of the present invention is providing a microwave energy moderator as described in the preceding paragraph which passively effects moderating microwave energy without moving.

Yet another additional major object of the present invention is providing means for enclosing a comestible article to be cooked by microwave energy so that the microwave energy field is sufficiently moderated to cook the article substantially uniformly without requiring power level changes, whether the article be initially frozen or unfrozen.

Another major object of the present invention is providing the enclosing means described in the preceding paragraph which further comprises means for obviating excessive loss of volatile and liquid constituents of the article while it is being cooked by microwave energy.

Yet another major object of the present invention is providing the enclosing means described in the preceding paragraphs which further comprises means for draining liquids from the enclosing means while the article is being cooked in a microwave oven.

Still yet another major object of the present invention is providing the enclosing means described in the preceding paragraphs which sufficiently moderate the cooking rate to substantially reduce the criticality of timing microwave cooking periods.

Yet still another major object of the present invention is providing the enclosing means described in the preceding paragraphs which further comprises means for substantially reducing the rate of cooking in a microwave oven as cooking progresses.

An additional major object of the present invention is providing utensils, bags, wraps, vessels, oven liners, and packages and the like which comprise microwave moderating enclosing means such as described in the preceding paragraphs.

Yet another additional object of the present invention is providing such microwave moderating enclosing means as described above which enable independently enclosing a plurality of comestible articles in a microwave oven so that they can be cooked simultaneously in a predetermined time period without overcooking any of the articles.

Another object of the present invention is providing microwave moderating enclosure means which substantially obviate the need to periodically reposition a comestible article as it is being cooked in a microwave oven.

Another object of the present invention is providing a microwave moderating enclosure means which will shrink about an article being cooked in a microwave oven and, upon ceasing to shrink, provide a predetermined degree of doneness of the article.

Still yet another object of the present invention is providing disposable microwave moderating elements for durable cooking vessels and/or oven liners which are otherwise microwave reflective.

An additional major object of the invention is to provide an improved microwave oven having a passive liner or interior enclosure which sufficiently moderates the oven's microwave energy that there is a generally uniform field of microwave energy inside the liner or interior enclosure.

SUMMARY OF THE INVENTION

These and other objects of the invention are achieved by providing a microwave moderator which substantially fully comprises a predetermined array of alternately disposed portions of microwave reflective material and complemental-shape zones which are substantially transparent to microwave energy of a predetermined frequency. The moderator can comprise a perforated sheet of microwave reflective material or a plurality of spaced microwave reflectors. Such moderator embodiments can further comprise means for causing the moderator to transition from being relatively transparent to being substantially less transparent to microwave energy of a predetermined frequency range when the temperature of the moderator is increased through a predetermined temperature range. Such a means for causing the moderator to be temperature responsive or activated may comprise heat shrinkable thermoplastic material. The moderator can further comprise means for providing predetermined degrees of vapor and liquid permeability for venting and draining an article enclosed in such a moderator while the article is being cooked in a microwave oven. Such a moderator can be made in the form of a bag, a wrap, a cooking vessel, a liner for a microwave oven or other microwave cooking device, or a package, or incorporated in other such articles which are otherwise substantially microwave reflective.

The phrase "substantially fully comprised of a predetermined array" as used in this application means there are no relatively large areas of microwave reflective materials in moderator embodiments of the present invention, or in the walls of other microwave energy cooking structures or enclosures comprising such a moderator except for the microwave reflective portions of the "predetermined array", and for unperforated border areas of perforated sheets of microwave reflective material incorporated in such a moderator or such other structures.

BRIEF DESCRIPTION OF THE DRAWINGS

While the specification concludes with claims particularly pointing out and distinctly claiming the subject matter regarded as forming the present invention, it is believed the invention will be better understood from the following description taken in connection with the accompanying drawings wherein like reference designators identify similar parts throughout the various views and in which:

FIG. 1 is a partially peeled apart perspective view of a laminated wrap embodiment of the present invention which embodiment has an equilateral triangular, delta-shape aperture array.

FIG. 2 is an enlarged scale, partially torn away, fragmentary plan view of the wrap shown in FIG. 1.

FIG. 3 is an enlarged scale sectional view taken along line 3—3 of FIG. 2.

FIG. 4 is an enlarged scale sectional view taken along line 4—4 of FIG. 2.

FIG. 5 is a partially torn away, fragmentary plan view similar to FIG. 2 but which shows a wrap such as shown in FIG. 1 after the wrap has been shrunken and crumpled.

DESCRIPTION OF PREFERRED EMBODIMENTS

Figure 6:
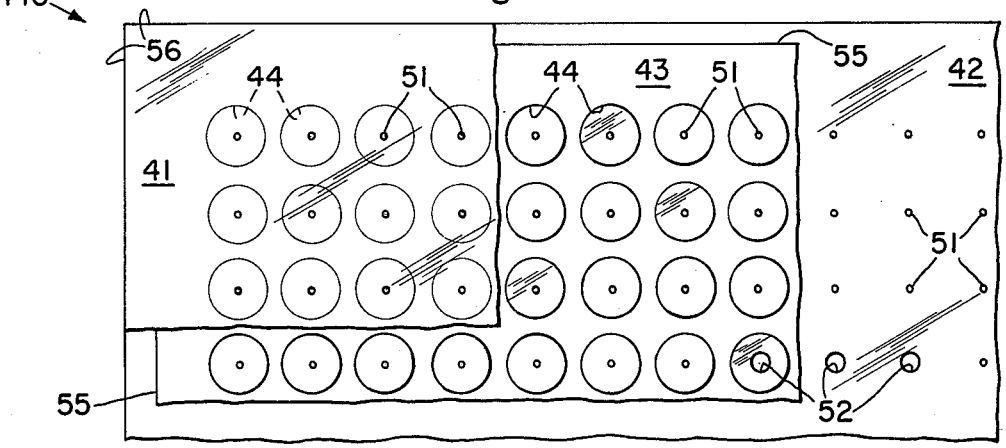
FIG. 6 is an enlarged scale, partially torn away plan view similar to FIG. 2 which shows an alternate wrap embodiment of the present invention having an orthogonal-shape aperture array.

A laminated, microwave moderating wrap 40 embodying the present invention is shown in FIGS. 1 through 4 with thicknesses greatly enlarged for clarity. Wrap 40 comprises three laminae: a first thermoplastic film 41; a second thermoplastic film 42; and a sheet 43 of electrically conductive, microwave reflective material such as aluminum foil which sheet 43 has a multiplicity of apertures 44 through it. Wrap 40 further comprises means such as adhesive layers 47 and 48, FIG. 3, for bonding films 41 and 42 in face-to-face relation to the opposite surfaces of sheet 43.

Figure 11:
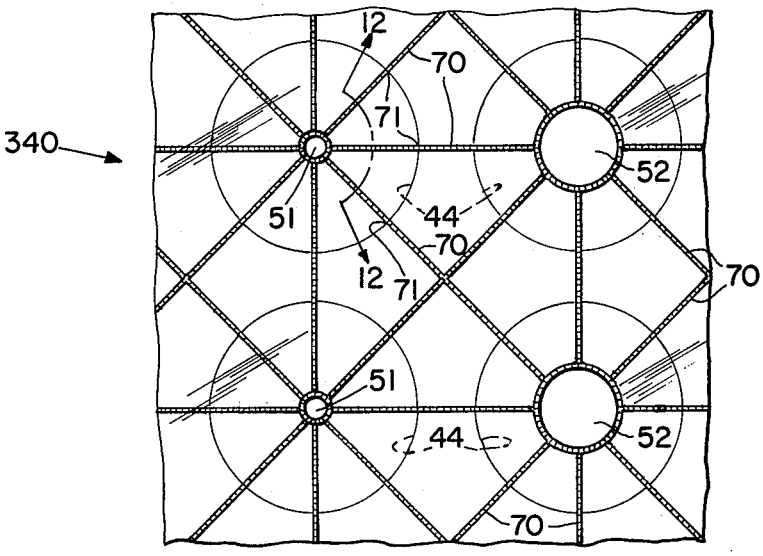
FIG. 11 is an enlarged scale, fragmentary plan view of a laminated wrap embodiment of the present invention in which the laminae are secured together in face-to-face relation by spaced bonds such as weld lines.

As will be described fully hereinafter, adhesive layers 47, and 48, FIG. 3, and adhesive layer 49, FIG. 4, and spaced bonds such as weld lines, FIG. 11, are exemplary bonding means. It is not intended, however, to thereby limit the present invention. Moreover, it is not intended to limit the present invention to laminated structures wherein a plurality of discrete laminae are secured together as by adhesives, welding, and the like. Rather, the term laminated is intended to means multi-layered or multi-ply structures in general and is specifically intended to include multi-layered structures of the type wherein a layer of material such as thermoplastic is cast or extruded directly onto a substrate such as a sheet of aluminum foil or a thermoplastic film. In the same vein, the terms lamina, ply, and layer are used alternatively herein unless specifically distinguished or otherwise restrictively defined.

While the present invention may be incorporated in discrete microwave moderators as well as microwave moderating wraps, bags, vessels, microwave oven liners, and packages or containers and the like, the following descriptions are, in general, of wraps only. It is, however, not intended to thereby limit the present invention to wrap-type embodiments. Further more, it is believed that the present invention is not limited to microwave cooking of comestible material. Accordingly, while it is understood that embodiments of the invention which are used for microwave cooking should be constructed exclusively of food approved materials, it is not intended to thereby limit the invention to constructions consisting exclusively of food approved materials.

Briefly, the laminated wrap 40, FIG. 1, is a microwave energy moderating wrap for enclosing an article to be heated (e.g., cooked) in a field of microwave energy (i.e.: in a microwave oven) of a predetermined frequency range. That is, for instance, when an article (e.g.: a beef roast) to be cooked is enclosed in such a wrap and placed in a microwave oven, it is believed that the level or intensity and/or the uniformity of microwave energy inside the wrap may be somewhat attenuated and/or moderated as compared to the microwave energy intermediate the oven walls and the wrap-formed enclosure. This is because, when microwave energy is directed towards a perforated member or sheet of microwave reflective material, some of the energy is reflected, some passes through the perforations of the member in the form of propagating waves, and some of the energy produces evanescent fields adjacent the perforations.

Indeed, it is believed that such moderation of a microwave energy field to effect more uniformity of the microwave energy field is somewhat analogous to the effects light diffusers have with respect to light. It is also believed that such a microwave moderating enclosure may precipitate a substantially more uniform field of microwave energy throughout the oven than were such a microwave moderating enclosure not present.

Both static and dynamic embodiments of the invention are disclosed: static embodiments being such that their relative degrees of transparency, transmissibility, attenuation, and/or moderation of microwave energy do not change substantially in use; and, dynamic embodiments being such that their relative degrees of transparency, transmissibility, attenuation and/or moderation of microwave energy do change substantially as the embodiments are heated. Therefore, as used herein, static embodiments of the present invention do not undergo substantial structural changes during microwave cooking whereas dynamic embodiments do undergo substantial structural changes as a result of temperature changes such as incurred during microwave cooking. That is, dynamic embodiments of the invention comprise means for undergoing sufficient structural changes to transition from being relatively transparent to being substantially less transparent to microwave energy of a predetermined frequency range as the temperature of the means is increased through a predetermined range of temperature. In this context, such means precipitate substantially reduced heating rates with respect to an enclosed article (e.g.: a beef roast) as the temperature increases; i.e., as the roast cooks.

As compared to conventional microwave oven cooking and as is described fully hereinafter, the benefits provided by the present invention include more even cooking, reduced weight loss, reduced need for attention and/or handling, and/or reduced criticality of timing microwave oven cooking. As is also described more fully hereinafter, the dynamic wraps provide visually perceivable manifestations of when such beef roasts have achieved predetermined degrees of doneness.

Referring back to FIGS. 1 through 4 of wrap 40, the first thermoplastic film 41 and the second thermoplastic film 42 comprise materials which are substantially transparent to microwave energy, have relatively low dielectric loss factors, and which are substantially impervious to many vapors and liquids encountered in cooking. Exemplary such materials are, for example, polypropylene, polyethylene, fluorocarbons, and polyimides.

Sheet 43 of wrap 40 is made of microwave reflective material such as aluminum foil which is a good electrical conductor. A predetermined array of apertures 44 is provided in sheet 43. As shown in FIG. 1, the array can be viewed as comprising three sets of rows of apertures 44: one set of rows having their imaginary centerlines extending generally horizontally, one set diagonally downwardly from left to right, and one set diagonally downwardly from right to left. Of course, each of the three sets comprise the full field of apertures 44 and are simply used to enable visualizing that their imaginary centerlines form imaginary triangles having the center of an aperture 44 disposed at each apex (i.e., at each point) of each triangle. Indeed, as can be perceived by viewing FIG. 2, the imaginary triangles are equilateral. Therefore, the array of apertures shown in FIG. 2 is hereby designated an equilateral triangular, delta-shape array. Apertures 44 are sufficiently large and sufficiently closely spaced to render the wrap substantially transparent to microwave energy of a predetermined frequency range yet sufficiently small and so spaced to cause microwave energy passing therethrough to be somewhat attenuated and/or moderated.

Still referring to sheet 43 of wrap 20, its edges and the edges of apertures 44 are preferably smooth and absent any sharp corners because rough edges and sharp corners precipitate localized zones of high field intensity which may, under some circumstances, result in some electrical arcing when a sheet 43 is disposed in a field of microwave energy.

Holes 51, FIGS. 2 and 3, and holes 52, FIG. 2, extend through the portions of films 41 and 42 which span apertures 44 and are nominally concentric with their associated apertures 44. Holes 51 and/or 52 are provided as necessary to provide predetermined degrees of vapor and liquid permeability so that particular types of foods to be cooked therein are adequately vented and drained. For instance, if adequate venting is not provided, the enclosure (e.g., pouch) might become dangerously pressurized, or the cooked matter may be excessively moist. Also, if juices are not drained from some foods as they are being cooked, the portions of the foods which are immersed in such juices may not be cooked to the same extent as the portions not so immersed.

FIG. 3 is a fragmentary sectional view of wrap 40 taken along line 3—3 of FIG. 2. For clarity, the relative thicknesses are exaggerated. In fact, in embodiments comprising thin (e.g., 60 gauge) films 41 and 42, and a thin (e.g., 0.35 mil) foil 43, and wherein apertures 44 have relatively large diameters (e.g., ¾ inch) the portions of films 41 and 42 which span apertures 44 are bonded in face-to-face relation; not spaced as indicated in FIG. 3.

Referring now to FIGS. 2 and 4, the edges 55 of the sheet 43 of aluminum foil are recessed a distance R from the edges 56 of wrap 40 to obviate exposed edges of the electrically conductive, microwave reflective aluminum foil. Electrically insulating electrically conductive portions of embodiments of the invention provides means for substantially obviating arcing when wrap 40 is disposed in a microwave energy field.

Such electrical insulating can be achieved, for instance, by covering or encapsulating the conductive portions in such thermoplastic insulation materials as described hereinbefore (e.g. polypropylene) which are substantially transparent to microwave energy, have relatively low dielectric loss factors, and which have relatively good dielectric properties. Such covering or encapsulating should be effected in such a manner that air pockets or bubbles do not form adjacent the microwave reflective material in order to obviate electrical arcing across air gaps. That is, in order to maximize the effectiveness of the covering and/or encapsulating materials. Alternatively, such electrical insulating can be achieved by providing means for sufficiently spacing conductive portions to provide air-gap insulation, and which portions may also be covered or encapsulated with insulation material as described above.

In an exemplary embodiment of wrap 40, FIGS. 1–4, for use in microwave ovens having a nominal frequency of 2.45 GHz, the use of which is described hereinafter, films 41 and 42 are sixty (60) gauge polyethylene; sheet 43 is aluminum foil having a thickness of thirty-five-hundredths of a mil (0.00035 inch); apertures 44 are three-quarters (¾) of an inch in diameter, and disposed in an equilateral triangular, delta-shape array spaced on one inch centers; and, holes 51 and 52 are about one-sixteenth (1/16) inch diameter and one-quarter (¼) inch diameter, respectively. Adhesives 47, 48 and 49 can be, for instance, spray adhesive type 3M-No. 77 which is available from The Minnesota Mining and Manufacturing Company, 3M Center, St. Paul, Minn. 55101, and type Cascorez EA-7908 which is a water base, ethylene vinyl acetate (EVA) adhesive, and which is available from Borden Chemical, Division of Borden Inc., 180 East Broad Street, Columbus, Ohio 43215. Such exemplary warps 40 were used in the cooking experiments which are described hereinafter and were made up in sheets which were sixteen (16) inches wide, twenty (20) inches long (about 40.6 by 50.8 cm.), and had a total of two-hundred-eighty apertures 44 per sheet of wrap 40. Also, a centrally disposed group of thirty-six (36) apertures 44 was provided with drain holes 52, and the remaining two-hundred-forty-four (244) apertures 44 were provided with vent holes 51. But for their unperforated borders, these wraps had open areas of about fifty (50) percent.

Referring yet again to FIGS. 1 through 4 inclusive, a dynamic embodiment of wrap 40 is achieved by having film 41 and/or 42 comprised of heat shrinkable thermoplastic. For instance, biaxially oriented polyethylene such as sixty (60) gauge Clysar which is available from E. I. DuPont DeNemours and Co. (Inc.), Film Department, Wilmington, Del., 19898, and which has a nominal latent shrink capacity of about forty percent (40%).

Also, dynamic embodiments of wrap 40 comprising a heat shrinkable thermoplastic film must further comprise means for securing the film to the perforated sheet 43 so that, when the film is shrunken, the effective sizes of apertures 44 in perforated sheet 43 are substantially reduced; for instance, as when sheet 43 is crumpled as shown in FIG. 5 and as is described hereinbelow. The adhesives identified hereinbefore enable such crumpling by rendering the thermoplastic film(s) partially or selectively peelable from a sheet 43 of aluminum foil. That is, the film and foil will become sufficiently delaminated (partially peeled apart) by shrinkage induced forces to effect crumpling of the foil. Alternatively, as described hereinafter, partial initial bonding such as lines of weld (rather than full face-to-face bonding) also enable sufficient shrink induced crumpling of the foil to occur that the effective sizes of apertures 44 are substantially reduced.

FIG. 5 is an artistic rendition of a fragmentary plan view of a dynamic wrap 40, FIG. 2, after it has been shrunken to about two-thirds (⅔) its original size by being used to enclose a beef roast while the roast was cooked in a microwave oven. The shrunken wrap is designated 40s. The other designators used for features of wrap 40, FIG. 2, are similarly converted to the designators in FIG. 5 through the use of the suffix "s" (for shrunken). As stated hereinabove, such shrinkage induces sufficient crumpling of the aluminum foil sheet 43 that the effective sizes of apertures 44 are sufficiently diminished that the relative degree of microwave transparency or transmissibility of wrap 40 is substantially reduced. For instance, apertures 44 having initial diameters of about nineteen millimeters (three-quarters-of-an-inch) and which were nominally spaced about twenty-five millimeters (one inch) between centers were diminished to having nominal mean diameters of about eleven millimeters (0.43 inches) and were nominally spaced about seventeen-and-one-half millimeters (0.69 inches) between centers as a beef roast was cooked as described above.

FIG. 6 is a fragmentary, partially torn away view of an alternate wrap 140 embodying the present invention. Alternate wrap 140 is substantially identical to wrap 40 but for the fact that apertures 44 of wrap 140 are disposed in an orthogonal-shape array comprising rows and columns of apertures which rows are perpendicular to the columns. The corresponding features of wrap 40, FIG. 2, and wrap 140, FIG. 6, are identified by the same designators as are the corresponding features of the other alternate embodiments of the invention which are shown in the figures. But for their unperforated borders, wraps 140 having three-quarter-inch diameter apertures 44 spaced on one inch centers have open areas of about forty-four (44) percent.

Figure 7:
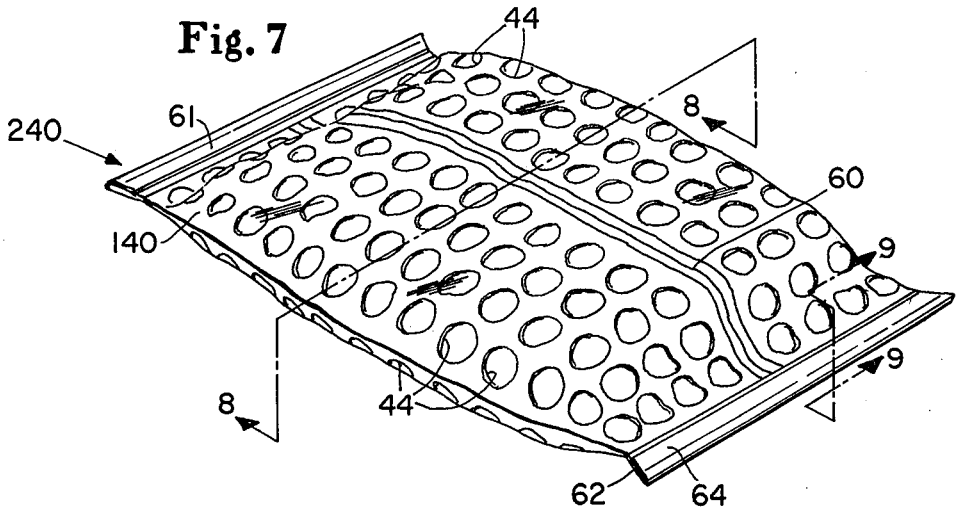
FIG. 7 is a perspective view of a cooking pouch comprising a wrap such as shown in FIG. 6.
Figure 8:
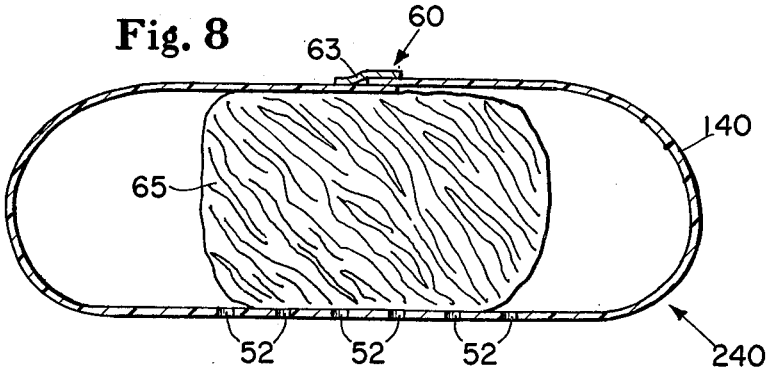
FIG. 8 is an enlarged scale sectional view taken along line 8—8 of FIG. 7.

FIG. 7 is a perspective view of a pouch type package 240 which comprises a wrap 140, FIG. 6, and which contains an article 65 such as a beef roast as shown in the sectional view, FIG. 8.

Figure 9:
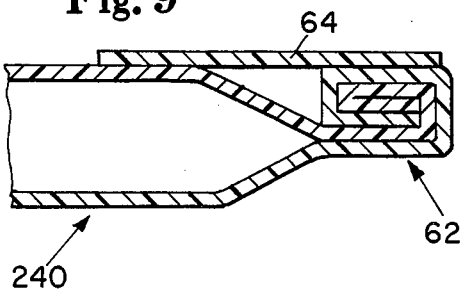
FIG. 9 is a greatly enlarged scale, fragmentary sectional view taken along line 9—9 of FIG. 7.

Pouch 240 is formed from a sheet of wrap 140 by folding it and seaming it along a longitudinal seam 60 and end seams 61 and 62 as indicated in FIGS. 7 through 9 inclusive. Seam 60 is secured by an adhesive faced tape 63, FIG. 8, and end seams 61 and 62 are secured by adhesive faced tapes 64, FIG. 9.

Pouch 240 is shown in FIG. 8 to be sufficiently large that it is, in fact, a very loosely fitted enclosure about roast 65. In the static embodiments of the invention, the looseness of the apertured pouch is believed to provide a moderated (i.e.: substantially uniform density) field of microwave energy inside the pouch when the pouch is disposed in an ON microwave oven even though a non-uniformly dense field of microwave energy might otherwise surround the pouch or, absent the pouch, surround the roast. Thus, it is believed that the pouch is a microwave moderator comprising a predetermined array of alternately disposed portions of microwave reflective material (cummulatively, the perforated sheet 43, FIG. 6) and complemental-shape zones (apertures 44 spanned by films 41 and 42, FIG. 6) which are substantially transparent to microwave energy of a predetermined frequency range: for instance, nominally 2.45 GHz.

Still referring to FIG. 8, the loose fit of pouch 240 enables such a pouch which comprises a dynamic wrap as described hereinbefore to shrink about the article as it is being cooked.

Still referring to FIGS. 7 and 8, holes 51 (vents) are not shown because of their relatively small size. However, holes 52 are shown in FIG. 8 disposed in the bottom wall portion of pouch 240. These holes 52 enable juices which issue, for instance, from a roast being cooked to drain from the pouch rather than accumulate inside the pouch. Thus, drain holes 52 are drain means for pouch 240.

Figure 10:
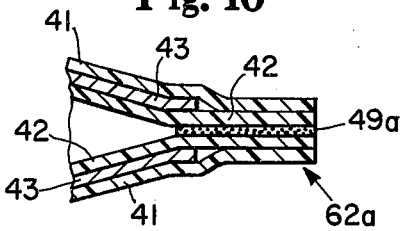
FIG. 10 is a fragmentary sectional view similar to FIG. 9 which view shows an alternate pouch seam construction.

FIG. 10 shows an alternate, adhesively bonded end seam construction **62*a* for a pouch such as pouch 240 which does not require the folding and taping shown in FIG. 9. Oppositely disposed portions of film 42 are secured together by adhesive 49*a* to form seam 62*a***.

Figure 12:
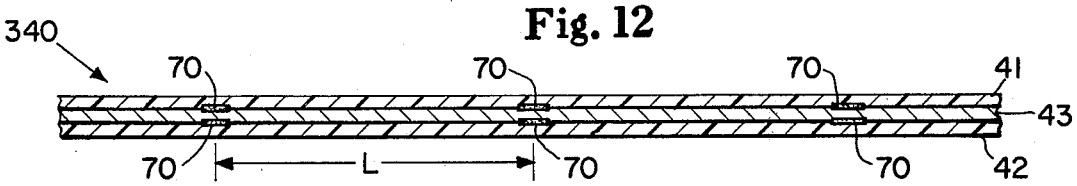
FIG. 12 is a sectional view taken along line 12—12 of FIG. 11.

Referring now to FIGS. 11 and 12, an alternate means for securing the films 41 and 42, and sheet 43 together to form an alternate, dynamically shrinkable three ply laminated structure 340 is shown to comprise lines 70 of securement such as weld lines, or lines of adhesive. Such lines of securement provide means for enabling the non-shrinkable sheet 43 of, for instance, aluminum foil to be crumpled when heated if either film 41 or film 42 or both comprise heat shrinkable thermoplastic material. In the embodiment shown, only film 42 is heat shrinkable thermoplastic.

Briefly, the lines 70 of securement intersect the edges of apertures 44 substantially perpendicularly at intersections 71 as indicated in FIG. 11. In FIG. 12, lines 70 appear as spaced areas of securement which areas are initially spaced a distance L apart.

Figure 13:
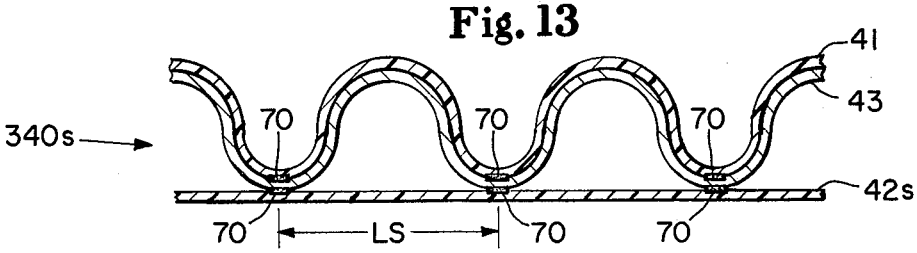
FIG. 13 is a sectional view similar to FIG. 12 after the laminated wrap shown in FIG. 11 has been shrunken and crumpled.

FIG. 13 shows the structure 340 of FIG. 12 after film 42 has shrunk and has been redesignated **42*s*. Essentially, as film 42 shrinks, the distance between adjacent lines 70 of securement is reduced from L, FIG. 12, to LS, FIG. 13. This causes portions of the non-shrinkable film 41 and sheet 43 to hump as shown in FIG. 13. While the 340*s* configuration appears to simply be corrugated, the macroscopic effects of the shrinkage and humping cause the structure 340 to crumple so that the effective size and the center-to-center spacing of apertures 44 are reduced as described hereinbefore; reference discussion with respect to FIG. 5**.

Figure 14:
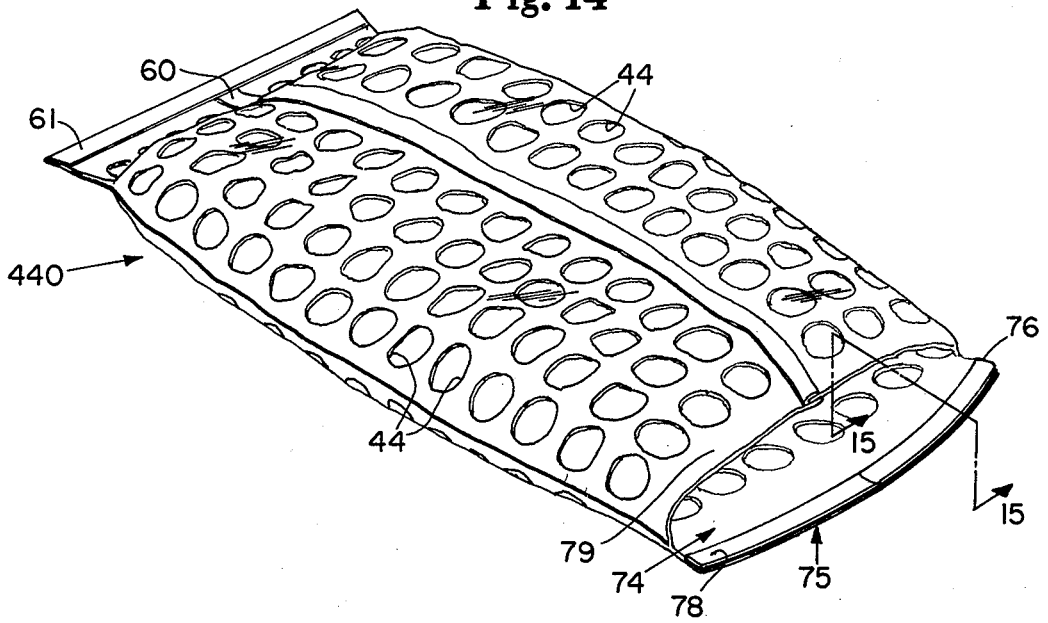
FIG. 14 is a perspective view of an oven bag embodiment of the present invention.
Figure 15:
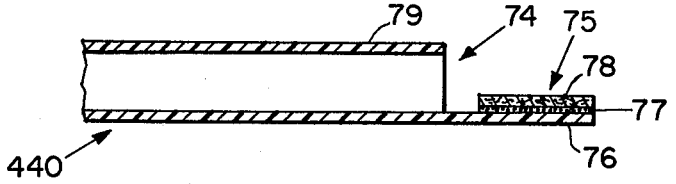
FIG. 15 is an enlarged scale sectional view taken along line 15—15 of FIG. 14.
Figure 16:
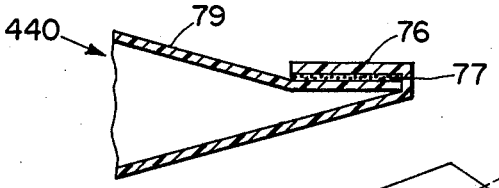
FIG. 16 is a sectional view similar to FIG. 15 after the open end of an oven bag, FIG. 14, has been sealingly closed.

A closeable bag 440 embodying the present invention is shown in FIG. 14 to strongly resemble pouch 240, FIG. 7, and is intended to perform substantially the same functions (both static and dynamic) described in conjunction with pouch 240. Therefore, the corresponding portions are identified by the same designators. However, bag 440 is provided with a closeable open end 74, and closure means 75 for securing the open end closed. Closure means 75, FIGS. 14 and 15, comprises an extended tab portion 76 of the bag, a coating of adhesive 77, and a peelable strip 78. To close and seal bag 440, strip 78 is peeled off; then, tab 76 is folded to overlie the front wall 79 of bag 440 and to be secured thereto by adhesive 77. Of course, such a closure means as 75 is intended to merely be exemplary rather than exhaustive, it being contemplated that those skilled in the art will substitute other closure devices: for instance, zippers or quasi zippers such as zip-locks (i.e.: releasably interlocking ridge and channel in plastic articles).

ALTERNATE BAG EMBODIMENTS

Figure 33:
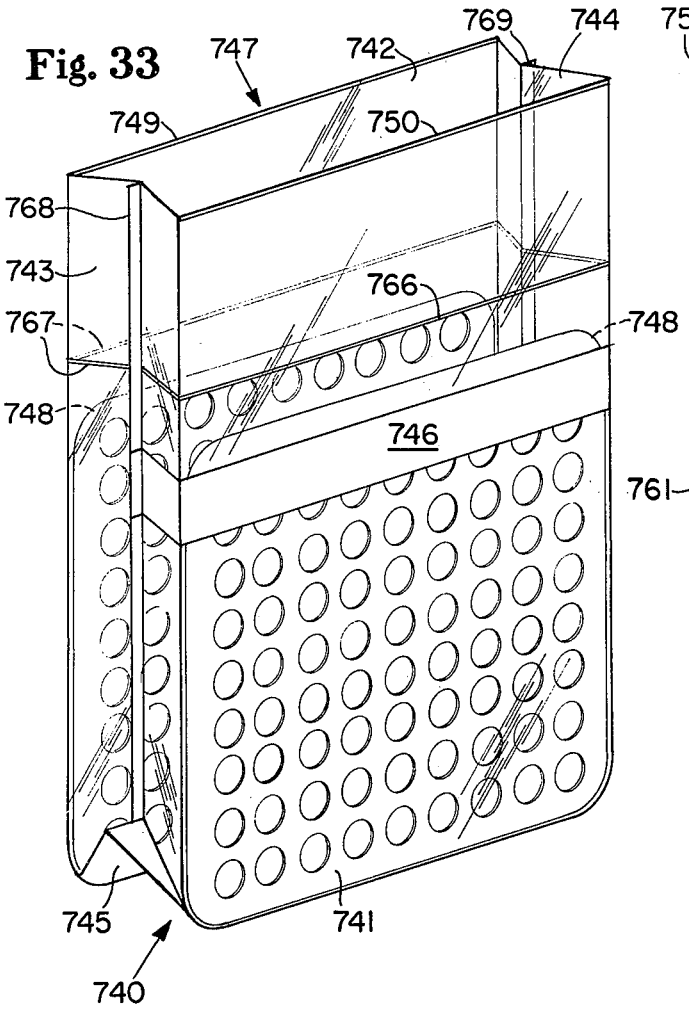
FIG. 33 is a perspective view of an alternate bag-type embodiment of the present invention.

Another closeable, microwave energy cooking bag 740 embodying the present invention is shown in perspective in FIG. 33 to comprise a front wall 741, a back wall 742, side gussets 743 and 744, a bottom gusset 745, a strap 746, and an open top end 747. The front wall 741 and the back wall 742 comprise microwave moderators of the type described hereinbefore. That is, each is a three ply laminate having a perforated sheet 748 of microwave reflective material such as aluminum foil disposed intermediate two laminae of thermoplastic films which films are selected from materials which are substantially transparent to microwave energy, and which have a low dielectric loss factor and which are relatively good electrical insulators. The top edges of the front wall 741 and the back wall 742 are designated 750 and 749, respectively.

Figure 34:
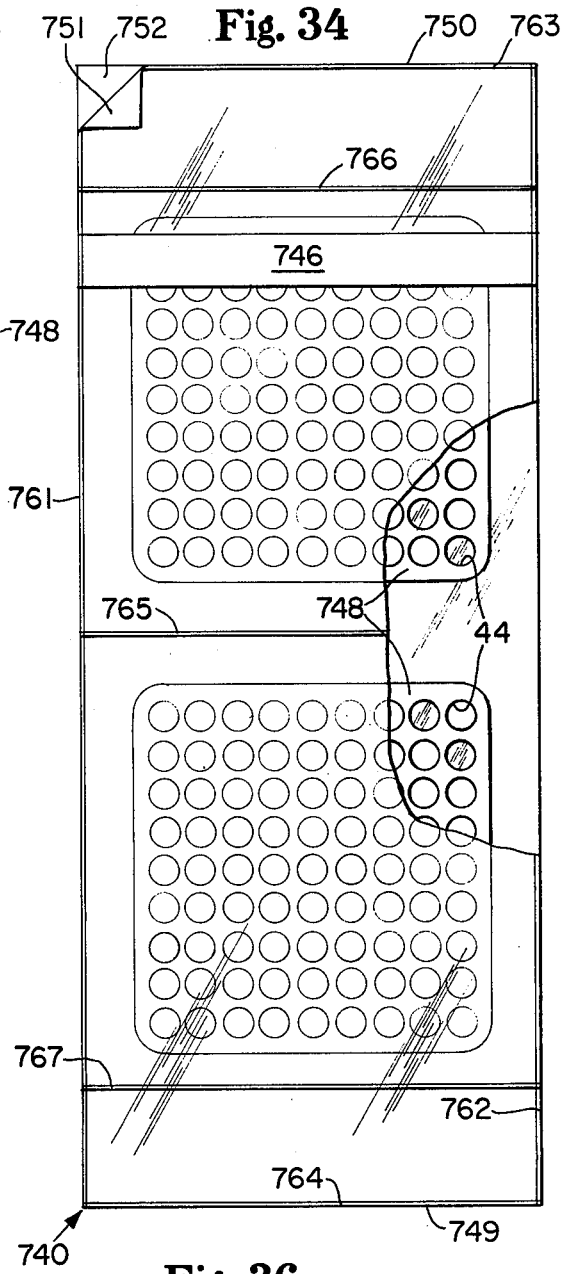
FIG. 34 is a plan view of a partially assembled microwave energy cooking bag of the type shown in FIG. 33.

FIG. 34 is a plan view of a partially assembled bag 740 which shows its three ply structure comprising a top or outer lamina 751, a bottom or inside lamina 752, and two spaced sheets 748 of microwave reflective material.

An exemplary bag 740 comprises ninety (90) gauge (0.9 mil) polypropylene laminae 751 and 752, and one mil aluminum foil for sheets 748. The polypropylene film is provided with a copolymer coating of polyethylene and polypropylene to render it heat sealable. Such a polypropylene film is Bicor OP-400S which is available from Mobil Chemical Company, Plastics Division, Commercial Films Dept., Macedon, New York 14502.

Sheets 748 of the exemplary bag 740 described above is one mil aluminum foil which is substantially fully perforated by apertures 44, FIG. 34, which are preferably about twenty-five millimeters (25 mm.) in diameter and are spaced about thirty-one millimeters (31 mm.) between centers.

In a medium size exemplary bag 740, sheets 748 are about thirty centimeters (30 cm.) square with rounded corners (about 3 cm. radius) and are perforated with a nine-by-nine array of twenty-five millimeter (25 mm.) diameter apertures 44 spaced on thirty-one millimeter (31 mm.) centers. These sheets 748 are placed between the two thermoplastic laminae 751 and 752 so that the sheets 748 are spaced from each other and so that the peripheral portions of the thermoplastic laminae 751 and 752 extend beyond all of the edges of sheets 748. The sheets 748 and the films are then heat bonded in face-to-face relation in, for instance, a laminator such as Serial No. HD 25-111, Model No. 1 nd. 25" which is available from Graphic Laminating, Inc., 5122 St. Clair Avenue, Cleveland, Ohio 44103. This tightly bonds face-to-face portions of the thermoplastic laminae 751 and 752 (i.e., the portions of laminae 751 and 752 spanning apertures 44, and the border portions) but does not tightly bond the thermoplastic films to the aluminum foil sheets 748.

The partially assembled bag 740 is completed to the state shown in FIG. 34 by placing a strap 746 (preferably comprised of substantially microwave transparent thermoplastic film) across the top portion of the partial assembly and then forming side bar seals 761 and 762, end bar seals 763 and 764, a transverse medial bar seal 765, and two transverse fold-line bar seals 766 and 767. A suitable bar sealer is Model No. 24 PS/WC which is available from Vertrod Corporation, Thermal Impulse Heat Sealing Machinery, 2037 Utica Avenue, Brookyln, N.Y. 12234.

The partially assembled bag 740 shown in FIG. 34 is converted into a finished bag 740, FIG. 33, by U-folding it about the transverse medial bar seal 765 so that bar seal 766 overlies bar seal 767, and then bar sealing the juxtaposed portions of the side bar seals 761 and 762 together to form side seams 768 and 769, FIG. 33. The peripheral portions of the thermoplastic laminae which extend outwardly from the side and bottom edges of sheets 748 are then folded or tucked inwardly to form the side and bottom gussets shown in FIG. 33.

Figure 35:
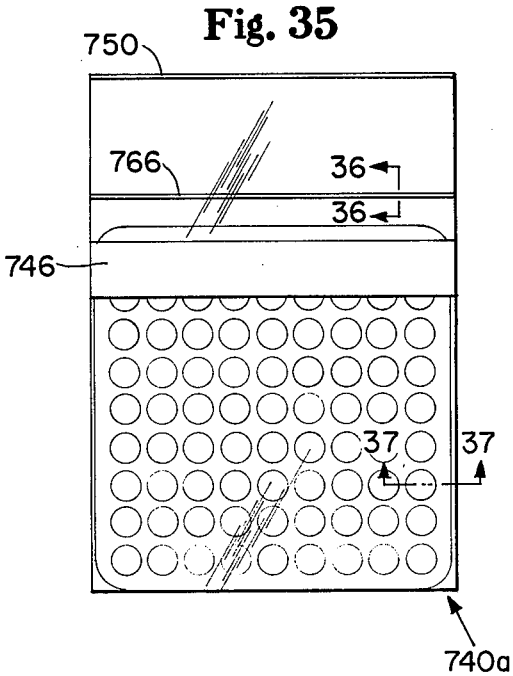
FIG. 35 is a frontal view of another alternate microwave energy cooking bag which, in the frontal view, is identical to the bag shown in FIG. 33.

FIG. 35 is a frontal view of a bag 740*a* which is identical to bag 740, FIG. 33 but for an alternate side seam construction having reduced bulk.

Figure 36:
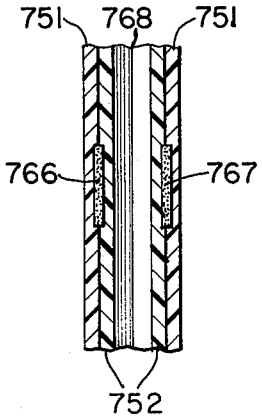
FIG. 36 is an enlarged scale, fragmentary sectional view taken along line 36–36 of FIG. 35.

The enlarged scale sectional view shown in FIG. 36 shows the juxtaposed relation of the fold-line bar seals 766 and 767 in the open, completed bag 740*a* as shown in FIG. 35.

Figure 37:
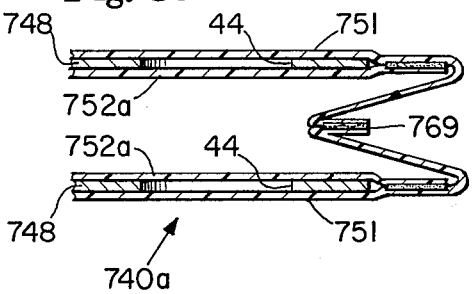
FIG. 37 is an enlarged scale, fragmentary sectional view taken along line 37—37 of FIG. 35.

FIG. 37 is an enlarged scale, sectional view taken along line 37—37 of FIG. 35 and shows a side seam and gusset construction wherein the gusset is primarily comprised of extended side-edge portions of only the outer thermoplastic lamina 751 to reduce the bulk of the gusset.

Figure 37A:
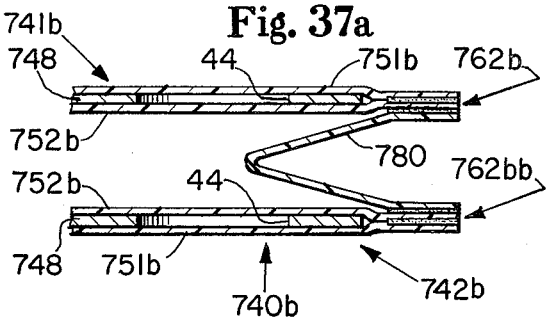
FIG. 37*a* is a fragmentary sectional view similar to FIG. 37 which view shows an alternate side seam construction for bags of the type shown in FIGS. 33 and 35.

FIG. 37*a* is an enlarged scale, sectional view of another alternate bag 740*b* having another alternate side seam and gusset construction as compared to the constructions shown with respect to bag 740, FIGS. 33 and 34, and bag 740*a*, FIGS. 35 and 37. In the 740*b* construction, the gusset is comprised of a discrete strip 780 of material such as thermoplastic film which is bar sealed to the edges of a discrete front wall 741*b* and a discrete back wall 742*b* along bar seals 762*b* and 762*bb*, respectively.

Figure 38:
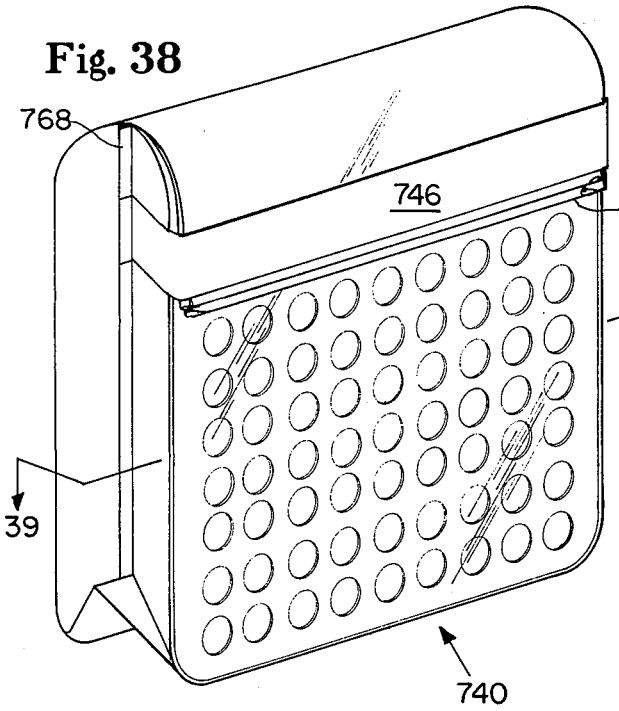
FIG. 38 is a perspective view of the bag shown in FIG. 33 after the bag's closure has been operated from its OPEN position to its CLOSED position.

FIG. 38 is a perspective view of bag 740, FIG. 33, after it has been erected, and closed by folding the extended top portion of the bag about the juxtaposed fold-line bar seals 766 and 767 so that the top portion of the bag is tucked under strap 746.

Figure 39:
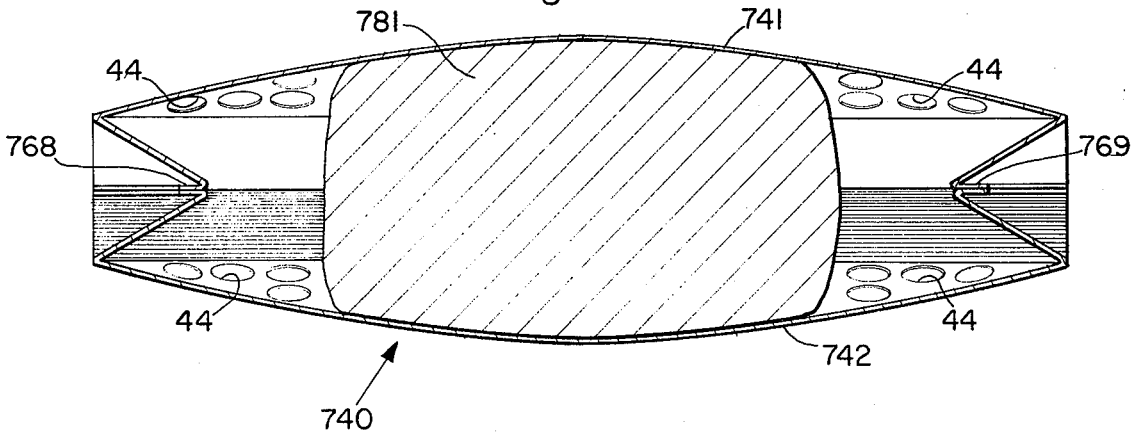
FIG. 39 is an enlarged scale, sectional view taken along line 39—39 of FIG. 38.

FIG. 39 is a sectional view taken along line 39—39 of FIG. 38 and which view shows the sheets 748 spaced apart by the extended portions of the thermoplastic laminae, and which shows an article 781 (such as a beef roast) in the bag to be cooked therein in a microwave energy field; e.g., in a microwave oven. The discrete laminae of the laminated structure are not shown in FIG. 39 in order to avoid unduly distorting the Figure with multiple laminae of exagerated thicknesses. Thus, the extended peripheral portions of the thermoplastic laminae 751 and 752 of bag 740 provides means for spacing adjacent edge portions of sheets 748 apart so that electrical arcing therebetween is substantially obviated. In cooking experiments involving bags 740, it has been determined that a substantial even cooking benefit as described hereinbefore can be realized with such spacing up to about seventy-five millimeters (75 mm.). Moreover, in such cooking experiments involving beef roasts, the folded but unsealed closure provides sufficient venting means to obviate dangerous pressurization of the bag 740. However, as described hereinbefore, additional vent and/or drain means may be provided as necessary for specific cooking applications. Reference, for instance, vent holes 51 and drain holes 52, FIG. 2.

Figure 40:
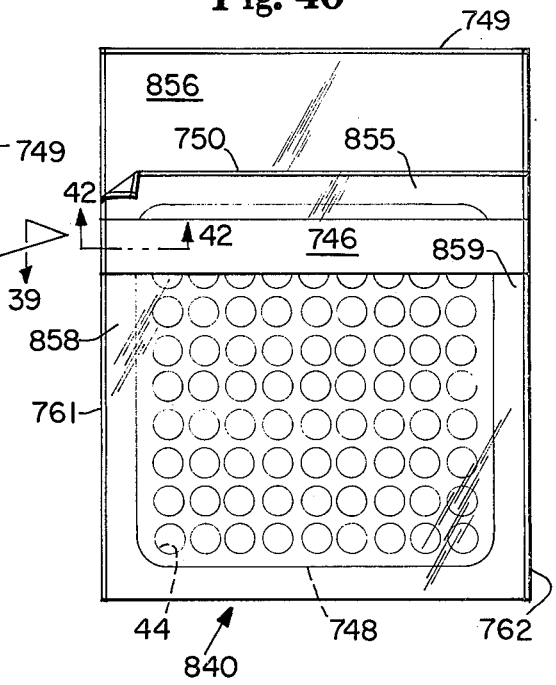
FIG. 40 is a partially peeled apart frontal view of another microwave energy cooking bag which embodies the present invention.

FIG. 40 is a frontal view of another alternate bag 840 which embodies the present invention which will, because it comprises many identical or substantially identical features (which are identically designated) as bag 740, FIG. 33, be described in terms of differences with respect to bag 740. Basically, bag 840 is constructed without gusseted sides and bottom, and the front flap 855 is shorter than the back flap 856.

Figure 41:
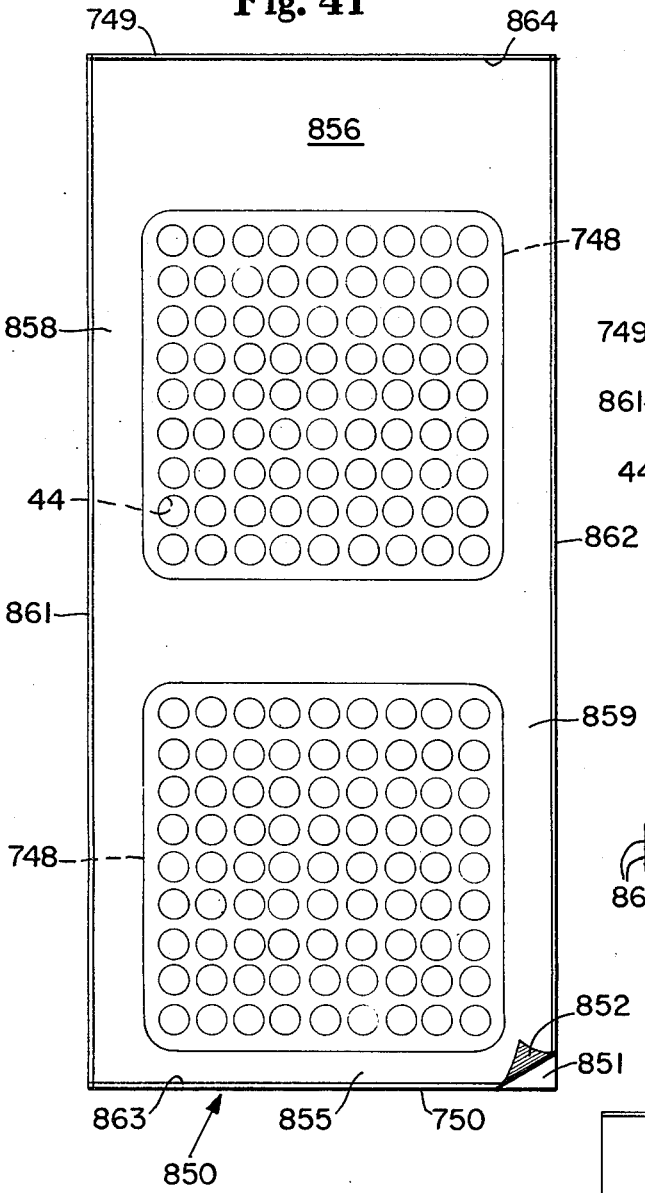
FIG. 41 is a partially peeled apart, plan view of a laminate which may be incorporated in a bag of the type shown in FIG. 40.

Briefly, bag 840, FIG. 40, comprises a strap 746, and a three ply laminate 850 which laminate is shown in the flat and partially peeled apart in FIG. 41. The laminate 850, FIG. 41, comprises an outer-wall lamina 851, an inside-wall lamina 852 and two spaced and perforated sheets 748 of a microwave reflective material such as aluminum foil. Laminae 851 and 852 are preferably comprised of substantially microwave transparent thermoplastic material having a relatively low dielectric loss factor.

An exemplary embodiment of laminate 850, FIG. 41, comprises ninety (90) gauge polypropylene film having a polypropylene-polyethylene co-polymer coating for laminae 851 and 852, and one (1) mil aluminum foil for sheets 748. This structure is heat bonded or laminated with sheets 748 spaced apart as indicated, and sheets 748 are so sized and positioned with respect to laminae 851 and 852 that, when so U-folded that the two sheets 748 are juxtaposed, FIG. 40, a relatively short front flap 855 and a relatively long back flap 856 extend upwardly from the top edges of sheets 748 as seen in FIG. 40. Also, the laminae 851 and 852 are sufficiently wide to provide non-microwave reflective side border regions 858 and 859 disposed beyond outwardly from the side edges of sheets 748.

Referring back to FIG. 41, the edges are bar-heat-sealed as described hereinbefore with respect to the partially assembled bag 740, FIG. 34. These bar seals are designated 861, 862, 863 and 864.

After the laminate 850, FIG. 41, is U-folded as described above, strap 746 is positioned transverse the front wall near its top edge. Then, the side edges are bar-heat-sealed to close the side edges of the bag and to secure strap 746 thereto to complete bag 840, FIG. 40.

Figure 42:
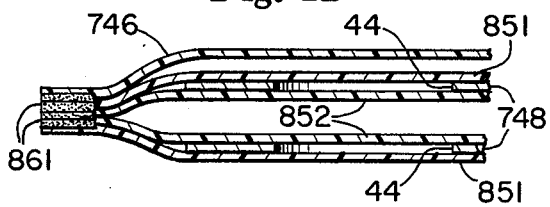
FIG. 42 is an enlarged scale, fragmentary sectional view taken along line 42—42 of FIG. 40.

FIG. 42 is an enlarged scale, fragmentary sectional view taken along line 42—42 of FIG. 40 which view shows the side seam construction through the region where an end of strap 746 is secured to the side seam.

Figure 43:
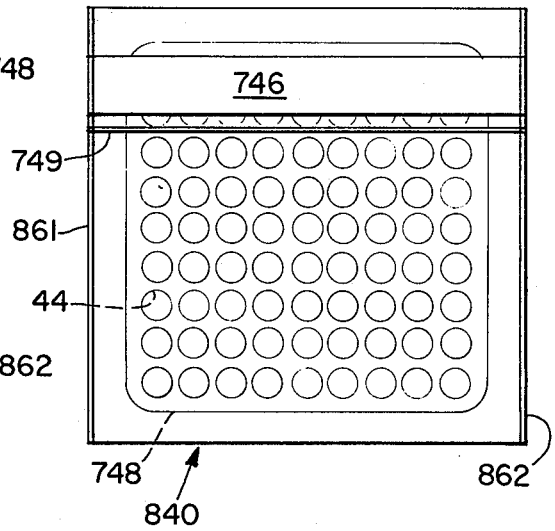
FIG. 43 is a frontal view of the bag shown in FIG. 41 after it has been closed.

FIG. 43 is a frontal view of bag 840, FIG. 40, after its back flap 856 has been folded about the top edge of the front flap 855 and tucked under strap 746. As compared to the closure of bag 740 described hereinbefore, the closure of bag 840 vents more freely.

When bag 840 has been erected as by having an article to be cooked placed in it and the bag is closed as described above, the extended edge or border portions of the theremoplastic laminae 851 and 852 provide means for all of the side edges of the sheet 748 disposed in the front wall of the bag to be spaced from the edges of the sheet 748 disposed in the back wall of the bag. This spacing provides improved arc resistance to bag 840. The wider the spacing, the better the arc resistance. However, the greater the spacing, the greater the unattenuated microwave energy transmission into the bag. Thus, the optimum spacing will be great enough to substantially obviate arcing but small enough to obviate the transmission of sufficient microwave energy to vitiate the even cooking benefit available from such structures. Some cooking experiments indicate that providing means for spacing the edges about twenty-five millimeters (25 mm.) apart substantially obviates arcing, although up to about seventy-five millimeters (75 mm.) does not seriously vitiate the even cooking benefit of a bag 840.

Figure 44:
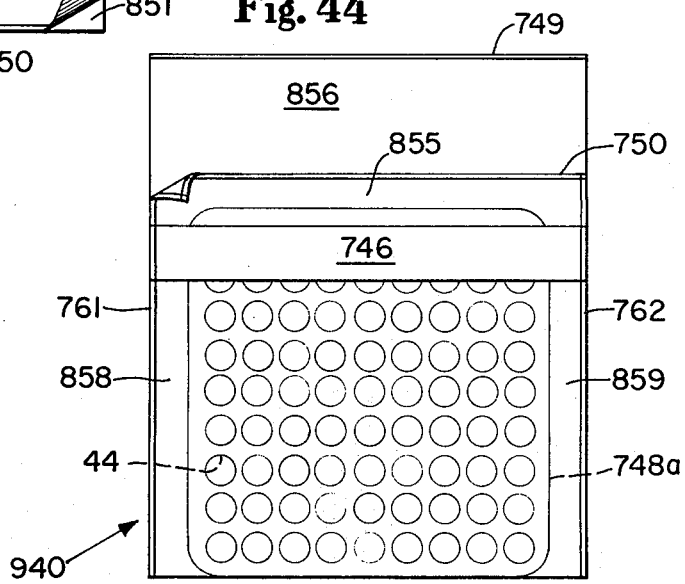
FIG. 44 is a partially peeled apart, frontal view of another alternate microwave energy cooking bag embodiment of the present invention.

FIG. 44 is a frontal view of another alternate bag 940 which embodies the present invention. As compared to bag 840 described above, bag 940 is virtually identical except it comprises a single integrated sheet 748*a* of microwave reflective material rather than two discrete sheets 748, FIG. 41.

Figure 45:
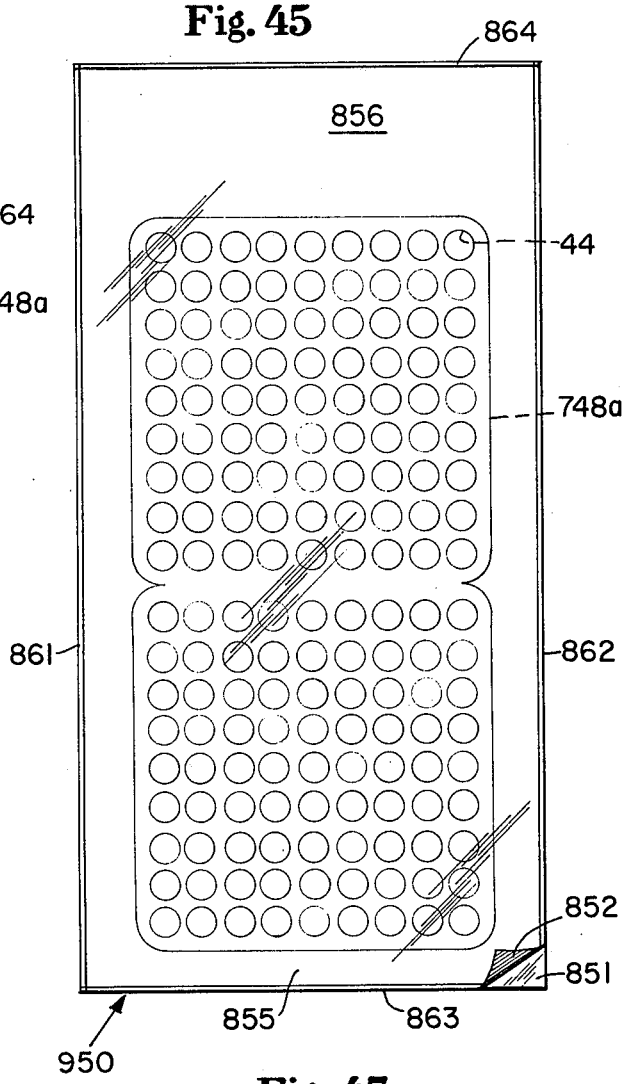
FIG. 45 is a partially peeled apart, plan view of a laminate which may be incorporated in a bag of the type shown in FIG. 44.

FIG. 45 is a partially peeled apart plan view of a three-ply laminate 950 from which bag 940 is constructed. The thermoplastic laminae of laminate 950 are identical to the thermoplastic laminae 851 and 852 of laminate 850, FIG. 41, and are so identified in FIG. 45, as are its bar-sealed edges 861, through 864. Laminate 950 is converted into bag 940, FIG. 44, in the same manner described above with respect to converting laminate 850 into bag 840.

Figure 46:
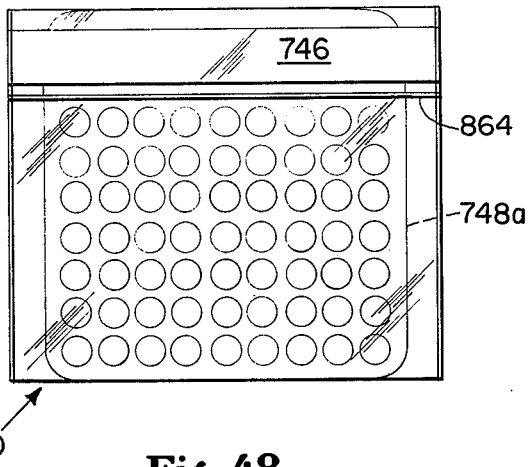
FIG. 46 is a frontal view of the bag shown in FIG. 44 after it has been closed.

FIG. 46 shows bag 940 after its front flap 855 and its back flap 856 have both been folded adjacent the top of sheet 748*a*, and tucked under the strap 746.

Figure 48:
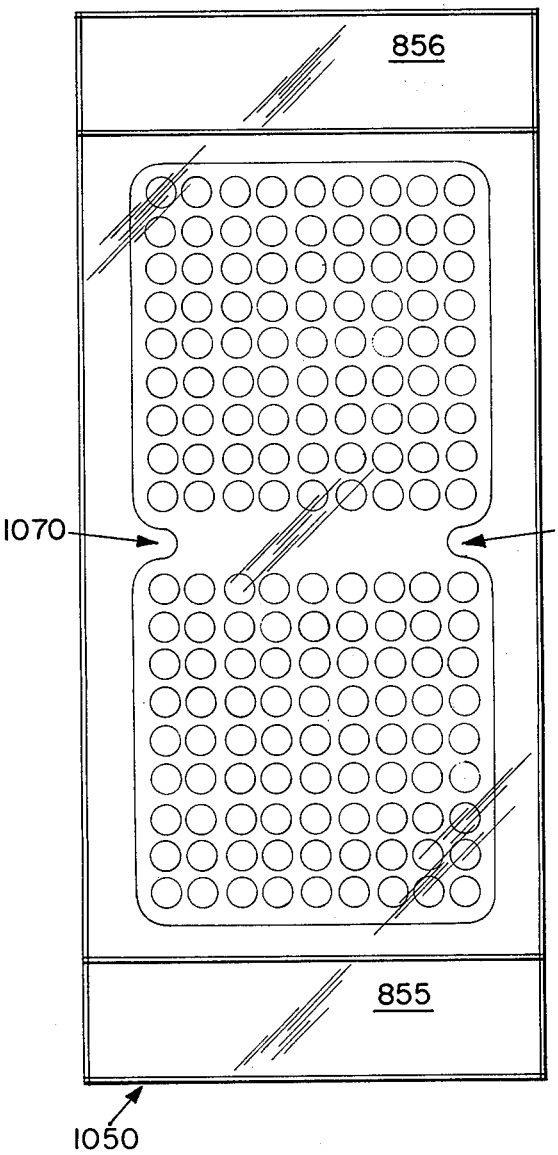
FIG. 48 is a plan view of a laminate which may be incorporated in a bag of the type shown in FIG. 47.
Figure 47:
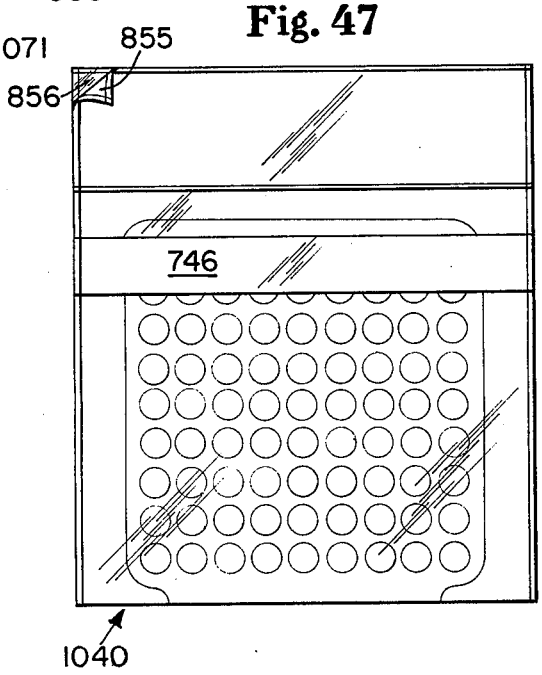
FIG. 47 is a partially peeled apart, frontal view of yet another alternate microwave energy cooking bag embodiment of the present invention.

FIG. 47 is a frontal view of yet another alternate bag 1040 which embodies the present invention. Bag 1040 is virtually identical to bag 940 described hereinabove except its closure flaps 855 and 856 are equal in length, and the single sheet 748*a* of microwave reflective material of bag 1040 is provided with oppositely disposed rounded notches 1070 and 1071, FIG. 48, which span the medical fold line of laminate 1050, FIG. 48. As compared to V-shape notches, the rounded edges of notches 1070 and 1071 tend to obviate or lessen the development of intense local electric fields when the bag 1040 is disposed in a microwave energy field.

Referring again to bags 740, 840, 940 and 1040, FIGS. 33, 40, 44, and 47, respectively, the exemplary embodiments described above are static. That is, they do not shrink or otherwise dynamically change their microwave energy shielding and/or moderating capacity during a cooking cycle; for instance, as a function of increasing temperature as described hereinbefore with respect to dynamic (temperature responsive) embodiments of the present invention. However, such bags can of course be made to be dynamic so that they become less transparent to microwave energy as they are heated by making one or both of the thermoplastic laminae of heat shrinkable thermoplastic and by bonding the structure together so that the effective sizes of the apertures in their perforated microwave reflective sheets are diminished as the heat shrinkable thermoplastic shrinks.

VESSEL EMBODIMENT

Figure 17:
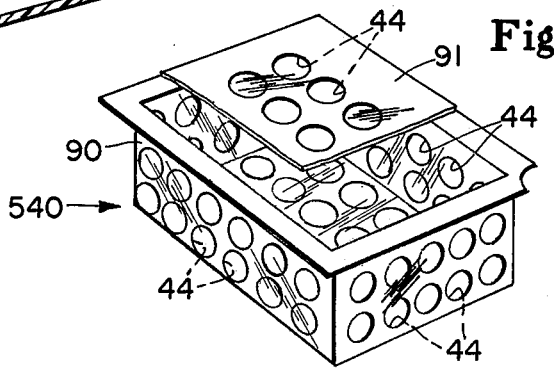
FIG. 17 is a reduced scale, partially torn away perspective view of a cooking vessel embodiment of the present invention.

A vessel 540 embodying the present invention is shown (partially torn away) in FIG. 17 to comprise a box-shape bottom member 90 and a cover member 91. Briefly, the bottom member 90 and the cover member 91 are provided with predetermined arrays of apertures 44 which are so sized and spaced that they perform the microwave energy moderating function described hereinbefore with respect to pouch 240, FIGS. 7 and 8. Moreover, vessel 540 can comprise means for obviating arcing, and means for venting and draining (such as holes 51 and 52, FIG. 2) as also described hereinbefore. Furthermore, such a vessel can also be provided with means not shown for providing the vessel with predetermined degrees of vapor and liquid permeability: for instance, holes 51 and/or 52 and peelable covers therefor. Of course, vessel 540 can be made to be disposable (single use) or reuseable (durable cooking utensil). Furthermore, containers such as vessel 540 can be used as food packages and the like which would enable merchandising, freezing, storing, cooking, and serving foodstuffs in microwave energy moderating embodiments of the present invention.

ALTERNATE WRAP EMBODIMENT

Figure 18:
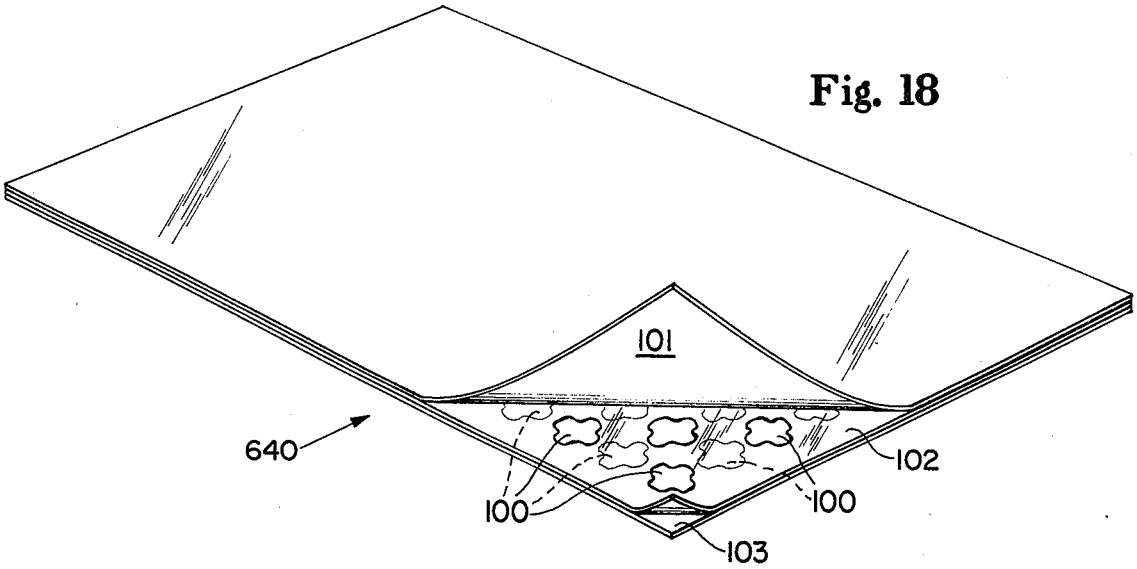
FIG. 18 is a partially peeled apart, perspective view of a dynamic laminated wrap embodiment of the invention comprising an orthogonal array of spaced microwave reflectors and three laminae of heat shrinkable thermoplastic material.

FIG. 18 is a perspective view of an alternate laminated wrap 640 embodying the present invention which wrap comprises an orthogonal-shape array of spaced microwave reflectors 100, three laminae or layers 101, 102, and 103 of substantially microwave transparent, thermoplastic material, and means for obviating arcing when said wrap is disposed in a field of microwave energy. Such materials and arc obviating means have been described hereinbefore.

Briefly, the reflectors are so sized, configured, and initially spaced, and are so related to the latent shrink capacity of the heat shrinkable thermoplastic laminae that the wrap is initially substantially transparent to microwave energy of a predetermined frequency range and, when shrunken by increasing its temperature through a predetermined range of temperature, the wrap will become substantially less transparent to the microwave energy because the reflectors move closer together; for instance, into overlapping positions. This movement (rather than crumpling) is enabled by securing the reflectors 100 to the thermoplastic material at relatively small areas 170, FIGS. 20, 21, and 23.

Figure 19:
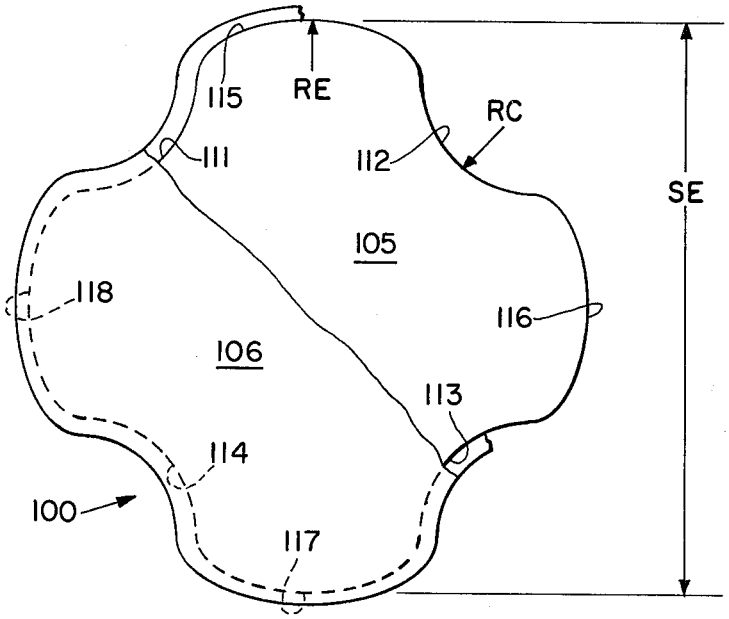
FIG. 19 is an enlarged scale, partially torn away plan view of an insulated microwave reflector of the wrap shown in FIG. 18.

Referring now to FIG. 19 which is an enlarged scale plan view of a reflector 100 of wrap 640, FIG. 18, reflector 100 is shown to comprise a four-lobe member 105 of a microwave reflective material such as aluminum foil, and an arc-obviating full sheath 106 (partially torn away) of electrical insulation material such as Teflon or Mylar (both registered trademarks of DuPont Company) having high dielectric strength and a relatively low dielectric loss factor.

A four-lobe member 105 which is suitable for use in a wrap 640 in a field of microwave energy having a nominal frequency of 2.45 GHz is defined (in the plan view) in the following way. First, four ninety-degree arcs having radii RC of three-sixteenths of an inch (about 4.75 millimeters) are drawn in the four corners of an imaginary square having side edges of length SE, FIG. 19. Those four arcs define the edge portions designated 111, 112, 113 and 114 in FIG. 19. Second, the tip edges 115, 116, 117 and 118 of the lobes are defined by half ellipses having minor and major axes (collectively designated RE in FIG. 19) of three-sixteenths-of-one-inch (about 4.75 millimeters) and three-eighths-of-one-inch (about 9.5 millimeters), respectively. The imaginary center of the ellipses are disposed at the midpoints of the side edges of the imaginary square described above. When such reflectors are incorporated in a wrap 640 which will shrink by about one-third when heated to a predetermined temperature, and said reflectors are initially spaced (FIG. 20) about one-and-one-eighth-inches (about 28.6 millimeters) between centers as shown in enlarged scale in FIG. 20, they will become spaced about three-quarters-of-one-inch (about 19 millimeters) between centers as shown in enlarged scale in FIG. 22 when the wrap is shrunken one third. They will then define, in the plan view, quasi apertures 144 having effective diameters of about three-eighths-of-one-inch (about 9.5 millimeters); sufficiently small to substantially reduce the relative transmissibility of microwave energy at 2.45 GHz with respect to the initial transmissibility of such microwave energy through the wrap.

Figure 20:
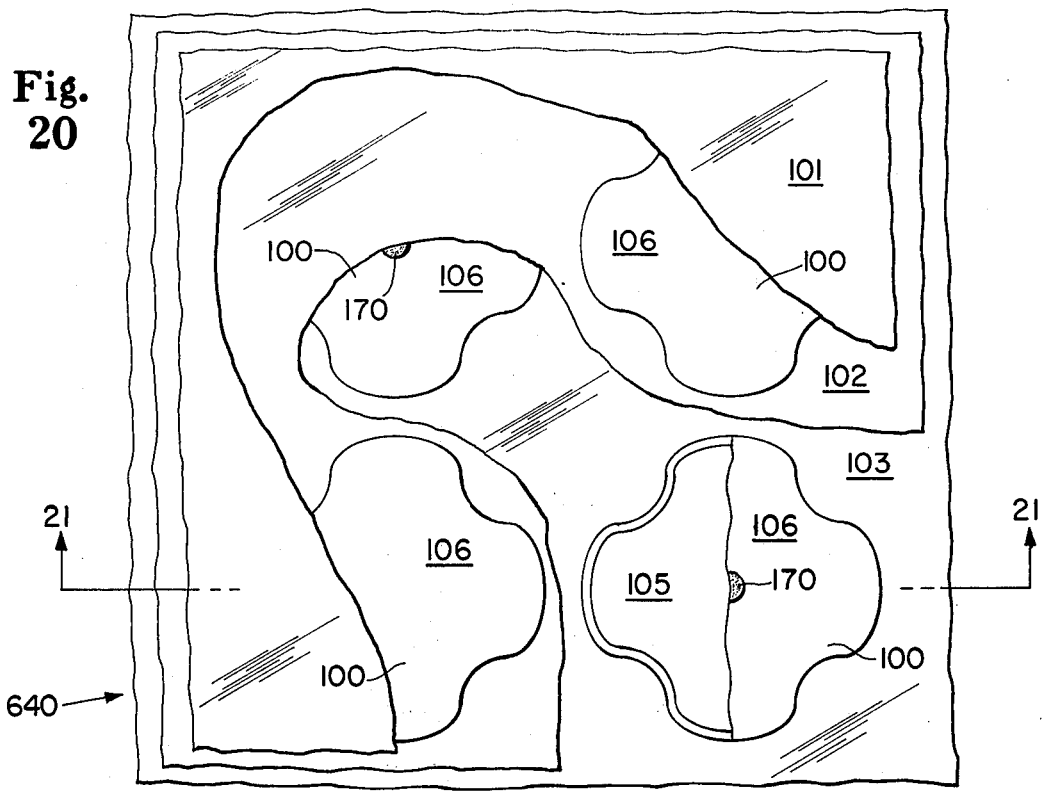
FIG. 20 is an enlarged scale, fragmentary, partially torn away plan view of the dynamic wrap shown in FIG. 18.
Figure 21:
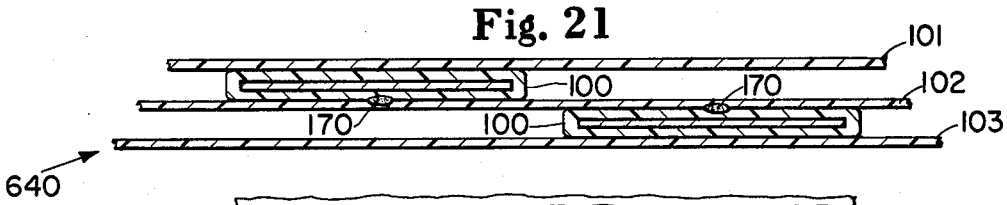
FIG. 21 is a fragmentary sectional view taken along line 21—21 of FIG. 20.

Referring now to FIGS. 20 and 21, wrap 640 is shown to have the row of reflectors 100 which extend diagonally upwardly from the lower left disposed intermediate layers 101 and 102 and, the row of reflectors 100 which extend diagonally downwardly from the upper left are disposed intermediate layers 102 and 103. The upper reflectors as shown in FIGS. 20 and 21 have relatively heavier weight outlines in FIG. 18 whereas the lower reflectors have relatively light weight outlines in FIG. 18.

Figure 22:
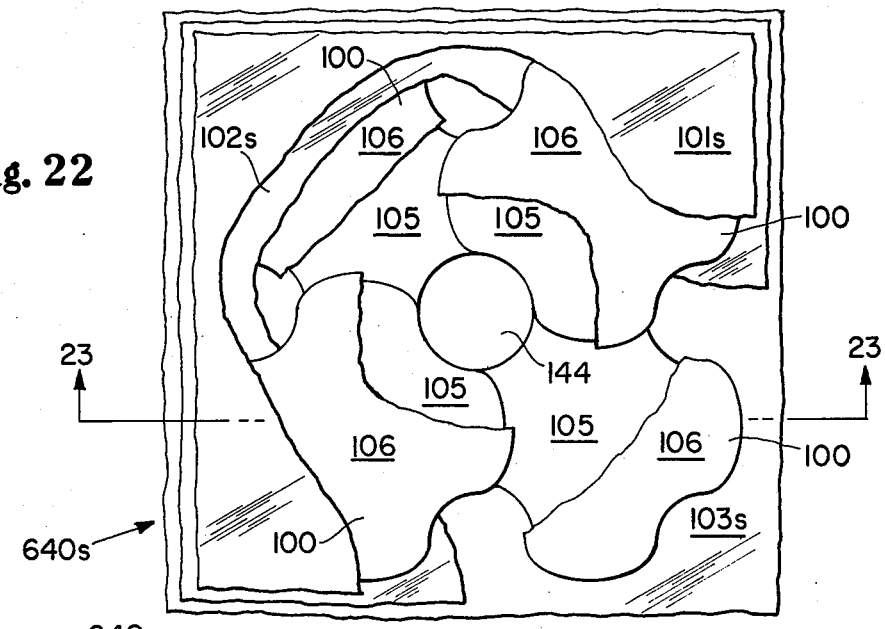
FIG. 22 is a fragmentary plan view of the dynamic wrap shown in FIG. 20 after its heat shrinkable thermoplastic laminae have been shrunken sufficiently to cause the microwave reflectors to become partially overlapped.
Figure 23:
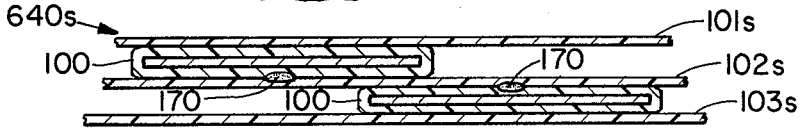
FIG. 23 is a fragmentary sectional view taken along line 23—23 of FIG. 22.

Referring again to FIGS. 20 (pre-activation wrap 640) and 22 (post-activation wrap 640S), only layers 101, 102, and 103 shrink; not the reflectors 100. By way of contrast, the microwave reflective portions of the dynamic embodiments of wraps 40 (FIG. 2) and 140 (FIG. 6), pouch 240 (FIG. 7), and bag 440 (FIG. 14) figuratively shrink as they crumple when they are activated. As indicated in FIGS. 22 and 23, the shrunken wrap 640 is designated 640*s* and the layers 101, 102, and 103 are designated 101*s*, 102*s*, and 103*s* in the shrunken wrap 640*s*.

MICROWAVE OVEN COOKING EXPERIMENTS

A number of beef roasts were prepared in microwave ovens to evidence the benefits of the present invention, and a number of water heating experiments were conducted in microwave ovens to evidence microwave energy phenomena related to the present invention. The resulting data are presented in TABLES I through IV, and in graphs, FIGS. 24 through 32.

Briefly, Tables I through IV are compilations of microwave oven cooking performance data derived from beef roasts enclosed in various embodiments of the present invention as well as corresponding data derived from similarly cooking unwrapped roasts, and roasts enclosed in oven bags: for instance, large-size (fourteen-by-twenty inch) BROWN-IN-BAGS (registered trademark of Reynolds Metals Company, Richmond, Va., 23261) which are believed to be made of Nylon 6 (registered trademark of DuPont Company). Also, briefly, FIGS. 24 through 29 are time vs. internal temperature graphs of some beef roast cooking experiments, and FIGS. 29 through 32 are graphs of data derived from water heating experiments conducted in microwave ovens which graphs pictorially illustrate the effects of varying certain parameters of the present invention.

More specifically, referring to Tables I through IV, fifteen series of cooking experiments were conducted to generate the data for the fifteen Example Series Numbers. That is, for instance, to determine the Evenness Ratings at Core Temperatures of 160° F. and 170° F. entailed cooking a roast to each temperature and then cutting them to determine their doneness and evenness.

TABLE I

EVENNESS RATINGS OF MICROWAVE OVEN COOKED BEEF ROASTS ENCLOSED IN WRAP EMBODIMENTS OF PRESENT INVENTION AND OF SIMILAR ROASTS NOT SO ENCLOSED

| Example Series No. | Control, Static or Dynamic | Brief Description of Wrap | Evenness Rating at Core Temperatures 160° F. | 170° F. |
|---|---|---|---|---|
| 1. | Unwrapped Control | No wrap, no rearrangement of food (100% power) | 4 | 1 |
| 2. | | No wrap, no rearrangement of food (70% power) | 6 | 5 |
| 3. | | No wrap, cookbook recommended arrangement of food and adjustment of power (100% power - 1st half; 70% power - 2nd half) | 8 | 7 |
| 4. | Wrapped | Oven bag, no rearrangement of food (100% power) | 4 | 1 |
| 5. | Control | Oven bag, cookbook recommended rearrangement of food and adjustment of power (100% power - 1st half; 70% power - 2nd half) | 8 | 8 |
| 6. | Static | Perforated foil, orthogonal-shape aperture array, loosely fitted pouch | 4 | 4 |
| 7. | (all at 100% power) | Perforated foil, orthogonal-shape aperture array, closely fitted pouch | 3 | 4 |
| 8. | | Perforated foil, orthogonal-shape aperture array, with one thermoplastic film layer; foil adjacent roast | 6 | 5 |
| 9. | | Perforated foil, orthogonal shape-aperture array, with one thermoplastic film layer; film adjacent roast | 7 | 7 |
| 10. | | Perforated foil, orthogonal-shape aperture array, intermediate two thermoplastic film layers | 9 | 7 |
| 11. | | Perforated foil, equilateral triangular, delta-shape aperture array, intermediate two thermoplastic film layers | 8 | 8 |
| 12. | Dynamic | Perforated foil, orthogonal-shape aperture array, with one layer of heat shrinkable thermoplastic film; foil side adjacent roast | 7 | 7 |
| 13. | (all at | Perforated foil, orthogonal-shape aperture array, with one | | |

TABLE I-continued

EVENNESS RATINGS OF MICROWAVE OVEN COOKED BEEF ROASTS ENCLOSED IN WRAP EMBODIMENTS OF PRESENT INVENTION AND OF SIMILAR ROASTS NOT SO ENCLOSED

| Example Series No. | Control, Static or Dynamic | Brief Description of Wrap | Evenness Rating at Core Temperatures 160° F. | 170° F. |
|---|---|---|---|---|
| | 100% power) | layer of heat shrinkable thermoplastic film; film side adjacent roast | 8 | 7 |
| 14. | | Perforated foil, orthogonal-shape aperture array, intermediate two layers of heat shrinkable thermoplastic film | 9 | 8 |
| 15. | | Perforated foil, equilateral triangular, delta-shape aperture array, intermediate two layers of heat shrinkable thermoplastic film | 9 | 9 |

TABLE II

RETAINED WEIGHT RATIOS WEIGHTS OF MICROWAVE OVEN COOKED BEEF ROASTS ENCLOSED IN WRAP EMBODIMENTS OF PRESENT INVENTION RATIOED TO WEIGHTS OF SIMILAR ROASTS NOT SO ENCLOSED

| Example Series No. | Control, Static or Dynamic | Brief Description of Wrap | Ratio, retained weights, test condition: No wrap at core temp. 140° F. | 160° F. |
|---|---|---|---|---|
| 1. | Unwrapped Control | No wrap, no rearrangement of food (100% power) | 1.00 | 1.00 |
| 2. | | No wrap, no rearrangement of food (70% power) | 1.07 | 1.09 |
| 3. | | No wrap, cookbook recommended arrangement of food and adjustment of power (100% power - 1st half; 70% power - 2nd half) | 1.07 | 1.08 |
| 4. | Wrapped Control | Oven bag, no rearrangement of food (100% power) | 0.96 | 0.0 |
| 5. | | Oven bag, cookbook recommended rearrangement of food and adjustment of power (100% power - 1st half; 70% power - 2nd half) | 1.08 | 1.08 |
| 6. | Static | Perforated foil, orthogonal-shape aperture array, loosely fitted pouch | 1.17 | 1.18 |
| 7. | (all at 100% power) | Perforated foil, orthogonal-shape aperture array, closely fitted pouch | 1.10 | 1.07 |
| 8. | | Perforated foil, orthogonal-shape aperture array, with one thermoplastic film layer; foil adjacent roast | 1.13 | 1.07 |
| 9. | | Perforated foil, orthogonal-shape aperture array, with one thermoplastic film layer; film adjacent roast | 1.14 | 1.10 |
| 10. | | Perforated foil, orthogonal-shape aperture array, intermediate two thermoplastic film layers | 1.11 | 1.11 |
| 11. | | Perforated foil, equilateral triangular, delta-shape aperture array, intermediate two thermoplastic film layers | 1.13 | 1. |
| 12. | Dynamic | Perforated foil, orthogonal-shape aperture array, with one layer of heat-shrinkable thermoplastic film; foil side adjacent roast | 1.09 | 1.05 |
| 13. | (all at 100% power) | Perforated foil, orthogonal-shape aperture array, with one layer of heat shrinkable thermoplastic film; film side adjacent roast | 1.10 | 1.07 |
| 14. | | Perforated foil, orthogonal-shape aperture array, intermediate two layers of heat shrinkable thermoplastic film | 1.13 | 1.13 |
| 15. | | Perforated foil, equilateral triangular, delta-shape aperture array, intermediate two layers of heat shrinkable thermoplastic film | 1.12 | 1.09 |

TABLE III

ATTENTION REQUIRED FOR MICROWAVE OVEN COOKED BEEF ROASTS ENCLOSED IN WRAP EMBODIMENTS OF PRESENT INVENTION AND OF SIMILAR ROASTS NOT SO ENCLOSED

| Example Series No. | Control, Static or Dynamic | Brief Description of Wrap | Trips to Oven Active | Checking Only |
|---|---|---|---|---|
| 1. | Unwrapped Control | No wrap, no rearrangement of food (100% power) | 0 | Yes |
| 2. | | No wrap, no rearrangement of food (70% power) | 0 | Yes |
| 3. | | No wrap, cookbook recommended arrangement of food and adjustment of power (100% power - 1st half; 70% power - 2nd half) | 4 | Yes |

TABLE III-continued

ATTENTION REQUIRED FOR MICROWAVE OVEN COOKED BEEF ROASTS ENCLOSED IN WRAP EMBODIMENTS OF PRESENT INVENTION AND OF SIMILAR ROASTS NOT SO ENCLOSED

| Example Series No. | Control, Static or Dynamic | Brief Description of Wrap | Trips to Oven Active | Trips to Oven Checking Only |
|---|---|---|---|---|
| 4. | Wrapped Control | Oven bag, no rearrangement of food (100% power) | 0 | Yes |
| 5. | | Oven bag, cookbook recommended rearrangement of food and adjustment of power (100% power - 1st half; 70% power - 2nd half) | 4 | Yes |
| 6. | Static (all at 100% power) | Perforated foil, orthogonal-shape aperture array, loosely fitted pouch | 0 | Yes |
| 7. | | Perforated foil, orthogonal-shape aperture array, closely fitted pouch | 0 | Yes |
| 8. | | Perforated foil, orthogonal-shape aperture array, with one thermoplastic film layer; foil adjacent roast | 0 | Yes |
| 9. | | Perforated foil, orthogonal-shape aperture array, with one thermoplastic film layer; film adjacent roast | 0 | Yes |
| 10. | | Perforated foil, orthogonal-shape aperture array, intermediate two thermoplastic film layers | 0 | Yes |
| 11. | | Perforated foil, equilateral triangular, delta-shape aperture array, intermediate two thermoplastic film layers | 0 | Yes |
| 12. | Dynamic | Perforated foil, orthogonal-shape aperture array, with one layer of heat shrinkable thermoplastic film; foil side adjacent roast | 0 | No |
| 13. | (all at 100% power) | Perforated foil, orthogonal-shape aperture array, with one layer of heat shrinkable thermoplastic film; film side adjacent roast | 0 | No |
| 14. | | Perforated foil, orthogonal-shape aperture array, intermediate two layers of heat shrinkable thermoplastic film | 0 | No |
| 15. | | Perforated foil, equilateral triangular, delta-shape aperture array, intermediate two layers of heat shrinkable thermoplastic film | 0 | No |

TABLE IV

TIME IN PALATABILITY ZONE FOR MICROWAVE OVEN COOKED BEEF ROASTS ENCLOSED IN WRAP EMBODIMENTS OF PRESENT INVENTION AND OF SIMILAR ROASTS NOT SO ENCLOSED

| Example Series No. | Control, Static or Dynamic | Brief Description of Wrap | Minutes in Palatability Zone 125° F.–170° F. |
|---|---|---|---|
| 1. | Unwrapped Control | No wrap, no rearrangement of food (100% power) | 8 |
| 2. | | No wrap, no rearrangement of food (70% power) | 14 |
| 3. | | No wrap, cookbook recommended arrangement of food and adjustment of power (100% power - 1st half; 70% power - 2nd half) | 12 |
| 4. | Wrapped Control | Oven bag, no rearrangement of food (100% power) | 6 |
| 5. | | Oven bag, cookbook recommended rearrangement of food and adjustment of power (100% power - 1st half; 70% power - 2nd half) | 11 |
| 6. | Static (all at 100% power) | Perforated foil, orthogonal-shape aperture array, loosely fitted pouch | 17 |
| 7. | | Perforated foil, orthogonal-shape aperture array, closely fitted pouch | 20 |
| 8. | | Perforated foil, orthogonal-shape aperture array, with one thermoplastic film layer; foil adjacent roast | 19 |
| 9. | | Perforated foil, orthogonal-shape aperture array, with one thermoplastic film layer; film adjacent roast | 16 |
| 10. | | Perforated foil, orthogonal-shape aperture array, intermediate two thermoplastic film layers | 16 |
| 11. | | Perforated foil, equilateral triangular, delta-shape aperture array, intermediate two thermoplastic film layers | 13 |
| 12. | Dynamic (all at 100% power) | Perforated foil, orthogonal-shape aperture array, with one layer of heat shrinkable thermoplastic film; foil side adjacent roast | 20 |
| 13. | | Perforated foil, orthogonal-shape aperture array, with one layer of heat shrinkable thermoplastic film; film side adjacent roast | 25 |
| 14. | | Perforated foil, orthogonal-shape aperture array, intermediate two layers of heat shrinkable thermoplastic film | 22 |
| 15. | | Perforated foil, equilateral triangular, delta-shape aperture array, intermediate two layers of heat | |

TABLE IV-continued

TIME IN PALATABILITY ZONE
FOR MICROWAVE OVEN COOKED BEEF ROASTS ENCLOSED IN WRAP EMBODIMENTS OF PRESENT INVENTION AND OF SIMILAR ROASTS NOT SO ENCLOSED

| Example Series No. | Control, Static or Dynamic | Brief Description of Wrap | Minutes in Palatability Zone 125° F.–170° F. |
|---|---|---|---|
| | | shrinkable thermoplastic film | 20 |

Therefore, each "Example Series No." consisted of a plurality of discrete beef roast examples; that is, a series of discrete examples.

Each roast used in the cooking experiments was a lean sirloin tip roast having a nominal weight of one-thousand (1,000) grams. The roasts had very little fat covering and little or no internal fat marbling. The roasts were refrigerated at about forty degrees fahrenheit (40° F.) from about one to about three days prior to use. Each roast was trimmed to achieve the nominal one-thousand (1000) gram weight. The roasts also had approximately the same shape: four-to-five inches (about 10 to about 13 centimeters) long and had about the same range of mean diameters.

Each roast (i.e.: every unwrapped, bagged, and wrapped roast) was placed on a microwave-oven-safe Tray Model No. 428 made by Plastics Inc., Saint Paul, Minn. The tray was, in turn, placed in a nine-by-thirteen (9×13) inch (about 23 cm. by about 33 cm.) utility dish having a one-and-one-half quart capacity, namely Item Order No. M432 made by Anchor Hocking, Lancaster, Ohio. The combination of the tray and dish provided means for collecting liquids which issued from the roasts so that such liquids were spaced from the roasts to obviate their shielding the undersides of the roasts. The roast-tray-dish combinations were then placed in a Litton Model 418 microwave oven having a nominal (100%) power of about 650 watts at a nominal microwave frequency of about 2.45 GHz., and a nominal wavelength of about twelve-and-two-tenths (12.2) centimeters (4.82 inches).

Example Series No. 1 through 5 inclusive were cooked to provide comparison (control) data with which to evaluate several static and dynamic embodiments of the invention. Example Series No. 6 through 11 involved static embodiments of the present invention, and Example Series No. 12 through 15 involved dynamic embodiments of the present invention. All rating scales indicated on the tables range from 1 (low or poor) to 10 (high or good).

The term palatability zone as used herein and on Table IV means, with respect to beef roasts, the temperature range from 125° F. to 170° F. In microwave oven cooking of beef roasts, oven ON time as well as standing time determine the doneness of the roast. For instance, if the oven is turned OFF when the internal (core) temperature of the roast is 125° F. and the roast is then wrapped in foil for ten (10) minutes before serving, its doneness will be rare. Without standing time, an internal temperature of 140° F. must be reached to provide a doneness of rare. Similarly, an internal temperature of 155° F. plus ten (10) minutes standing time, or 170° F. without standing time will provide well done beef roasts. While the temperature range of 125° F.–170° F. defines what is commonly accepted as the palatability zone, especially with respect to conventional cooking, the zone is not absolute. Rather, roasts have been cooked through the use of the present invention to temperatures well above 170° F. (to and above 200° F.) and have not been overdone. That is, they were still quite palatable: juicy, and not hardcrusted or burned. Indeed, it appears that the present invention substantially extends the palatability zone upwardly and substantially obviates ruining a beef roast, for instance, by overcooking in a microwave oven unless it is grossly neglected.

EXAMPLE SERIES No. 1

The roasts of this series were all cooked at one-hundred percent (100%) power, none were wrapped, and none were repositioned while being cooked. Note: the Litton cookbook referred to hereinbefore recommends periodic repositioning to achieve more doneness uniformity. Briefly, Table I indicates moderate evenness (4) at 160° F. but a substantially lower evenness (1) at 170° F. with an overall time in the palatability zone (125° F. to 170° F.) of eight (8) minutes, Table IV. As indicated in Table II, the retained weights of this example series are the bases for comparisons with the other example series.

EXAMPLE SERIES No. 2

The roasts of this series were all cooked at seventy percent (70%) power, none were wrapped, and none were repositioned while being cooked. As compared to Example Series No. 1: Table I indicates a moderate improvement in evenness at 160° F. and a substantial improvement in evenness at 170° F.; Table II indicates a seven-to-nine percent (7–9%) higher retained weight; and Table IV indicates a reduced sensitivity to critical time inasmuch as time in the palatability zone increased from eight (8) to fourteen (14) minutes.

EXAMPLE SERIES No. 3

The unwrapped roasts of this series were cooked in what is believed to be the best contemporary manner for unwrapped roasts. The first halves of their cooking intervals were at one-hundred percent (100%) power and their last halves were at seventy percent (70%) power, and they were repositioned four (4) times during the cooking interval as indicated on Table III. These roasts had relatively high evenness ratings (Table I), and were comparable to Series 2 with respect to retained weight (Table II) and reduced time criticality (Table IV).

To summarize Series 1 through 3, repositioning is required (Series 3) to achieve good evenness at high power (100%). Also, moderate evenness can be achieved without repositioning by cooking at reduced power (70%; Series 2).

EXAMPLE SERIES No. 4

The roasts of this series were placed in oven bags and cooked at one-hundred percent (100%) power; they were not repositioned during the cooking interval. Overall, they were the worst of all the examples. They exhibited greatly increased criticality with respect to timing (Table IV), the same evenness as Series 1 (Table I), and a greater weight loss than Series 1 (Table II). Inasmuch as they went through the entire palatability zone in four (4) minutes, it seems probable that this manner of cooking would not generally be favored over the other manners described herein.

EXAMPLE SERIES No. 5

Each roast of this series was placed in an oven bag and cooked in the Litton cookbook recommended manner: one half time at one-hundred percent (100%) power; one half time at seventy percent (70%) power; and by repositioning it four (4) times during the cooking interval. Good evenness (Table 1) and improved weight retention (Table II) resulted as well as a moderate increase in the time in the palatability zone (Table IV).

By way of recapping the results of Example Series No. 1 through 5, achieving high evenness ratings required periodic repositioning of the roasts and/or reduced power levels and/or power level changes during the cooking interval. The relevance of this will become apparent hereinafter. Briefly, however, the present invention generally provides improved evenness without repositioning and/or power level changes and, in general, reduces the criticality of timing the cooking interval by increasing the time in the palatability zone. This is believed to be a substantial benefit notwithstanding the fact that microwave cooking is slowed down and that such slowing down might be perceived to be a detriment rather than a benefit.

Briefly, Example Series No. 6 through 15 were conducted by forming a pouch as described hereinbefore about the roast which pouch was of the configuration shown in FIG. 7 and comprised various wrap embodiments (without recessed edges) of the present invention. All of these examples were cooked at one-hundred percent (100%) power and they were not repositioned during the cooking interval. Except for Example Series 7, the pouches were loosely fitted as shown in FIGS. 7 and 8.

EXAMPLE SERIES No. 6

Each roast of this series was enclosed in a pouch comprising a static embodiment of the present invention comprised of only a sheet of aluminum foil (0.0007 inches thick) which was sixteen-by-twenty inches; was perforated with an orthogonal array of three-quarter-inch-diameter apertures 44, FIG. 6, which were spaced one inch between centers. But for the relatively narrow unperforated borders, such spacing provides a composite open area of about forty-four (44) percent. The number of apertures totaled two-hundred-fifty-two (252). The pouch was loosely fitted as shown in FIG. 8. As compared to Series 1, this series provided improved evenness at 170° F. (well done, Table I); improved weight retention (Table II); and a substantial increase in the time in the palatability zone (Table IV).

EXAMPLE SERIES No. 7

The wrap embodiment of the present invention used in this series was the same (foil only) as for Series 6. However, whereas the pouches of that series were loosely fitted, the pouches of this series were closely fitted. The benefits as reflected in Tables I through IV were about equal to Series 6 except this series had a smaller retained weight benefit (Table II). They had, however, substantially greater retained weight than the no-wrap Series 1 described above.

EXAMPLE SERIES No. 8

The wrap embodiment of the present invention which was used in this series was of the configuration identified 140 in FIG. 6 except it had only one thermoplastic layer rather than two. The thermoplastic layer was made from a BROWN-IN-BAG (registered trademark, Reynolds Metals Company which is believed to be one-hundred (100) gauge Nylon 6 (registered trademark, DuPont). The foil side was adjacent the roast during this series. As compared to no-wrap Series 1 and foil-only Series 6 and 7, these roasts exhibited improved evenness (Table I).

EXAMPLE SERIES No. 9

The wrap embodiment of the present invention which was used in Series 9 was the same as in Series 8 except the foil side was disposed to be outwardly facing in this series whereas it was inwardly facing in Series 8. Having the foil outside (Series 9) as compared to inside (Series 8) resulted in some improved evenness (Table I), and some improvement in retained weight at 140° F. (Table II). However, the time in the palatability zone was somewhat reduced as indicated in Table IV.

NOTE: While a decrease in the time in the palatability zone increases the attention normally required to control a microwave oven to achieve a predetermined degree of doneness, achieving improved evenness while cooking faster and without having to reposition anything in the oven is believed to be a benefit: especially with respect to those who have end-point-temperature control type microwave ovens.

EXAMPLE SERIES No. 10

The wrap embodiment of the present invention which was used in this series was the three layer wrap 140, FIG. 6. Layers 41 and 42 were made from BROWN-IN-BAGS (registered trademark, Reynolds Metals Company) as described above (Series 8), and sheet 43 was aluminum foil (0.00035 inches thick). The wraps were sixteen-by-twenty inches and had an orthogonal-shape array of three-quarter-inch diameter apertures 44 (totaling 252) spaced one inch between centers. As compared to the invention embodiments of the prior series, Series 10 provided a still further improved evenness (Table I).

EXAMPLE SERIES No. 11

The wrap embodiment of this series was the three layer wrap 40, FIGS. 1 and 2, having an equilateral triangular, delta-shape array of one inch diameter apertures 44 spaced one inch between centers (totaling 280). But for the unperforated borders, such spacing provides an open area of about fifty (50) (totaling 280). The wraps comprised the same materials of construction as described above with respect to Series 10.

Series 10 and 11 provided about equal benefits as indicated in Tables I through IV. However, as will be described hereinafter in conjunction with FIGS. 24 and 26, wrap 40 (delta-shape aperture array) provides a somewhat faster cooking rate than No. 10 (orthogonal-shape aperture array) and comprises about twelve percent (12%) less aluminum; a substantial benefit with respect to the conservation of such microwave reflective materials as aluminum foil.

Referring now to the dynamic embodiments of the invention which were used in Example Series No. 12 through 15, all of the heat shrinkable films were sixty gauge Clysar (registered trademark of DuPont Company) 60EH-F which is biaxially oriented polyethylene film made by DuPont. But for the different thermoplastic material, the wrap embodiments of the present invention which were tested in Series 12 through 15 were the same as in Series 8 through 11, respectively. That is, the static structures of Series 8 through 11 comprised Nylon 6 thermoplastic which is non-heat shrinkable whereas the structures of Series 12 through 15 were dynamic (heat shrinkable) because they comprised heat shrinkable, biaxially oriented thermoplastic (polyethylene). Also, all pouches were loosely fitted, and all were run at one-hundred percent (100%) power. Briefly, all provided: high evenness ratings (Table I) without requiring repositioning (Table III); substantially improved retained weights as compared to no-wrap Series 1; and reduced criticality of timing (inferred from Table IV) as compared to no-wrap Series No. 1. Moreover, as previously stated hereinbefore, the dynamic wraps substantially obviate overcooking/overdoneness of, for example, beef roasts cooked in microwave ovens except under extreme conditions: i.e., a grossly miscalculated cooking interval or simply being turned ON and forgotten for an extended period of time.

Furthermore, with respect to the dynamic embodiments of the present invention, they shrink about the article (e.g., beef roast) being cooked so that, when shrunken the wrap is drawn in closely about the article. The shrinkage reduces the effective areas of the apertures 44 and slows cooking. Indeed, when a dynamic embodiment of the invention is used to enclose a beef roast while it is cooked in a microwave oven, the cessation of shrinkage is a visually perceivable manifestation that the roast has a doneness of about rare and, if the oven is then turned OFF and the roast is given ten (10) minutes of standing time, it will have a doneness of about medium. Alternatively, if the power is left ON for about ten (10) minutes after shrinkage has ceased, and ten (10) minutes of standing time are provided, the roast will have a doneness of about well done. Thus, the present invention provides means for cooking an article (e.g.: a beef roast) to a pre-determined degree of doneness without monitoring the internal temperature of the roast and/or without having to control cooking as a function of the internal temperature of the article. This is believed to be a great benefit to microwave oven users whose ovens are not equipped with such sensors and/or control means.

GRAPHS

Briefly, FIGS. 24 through 28 are graphs of data generated by cooking beef roasts in microwave ovens under various conditions and/or which were enclosed in various embodiments of the present invention as described hereinbefore. Some but not all of the graphed data were obtained from the fifteen (15) aforementioned Example Series which were run and upon which Tables I through IV are based.

Figure 24:
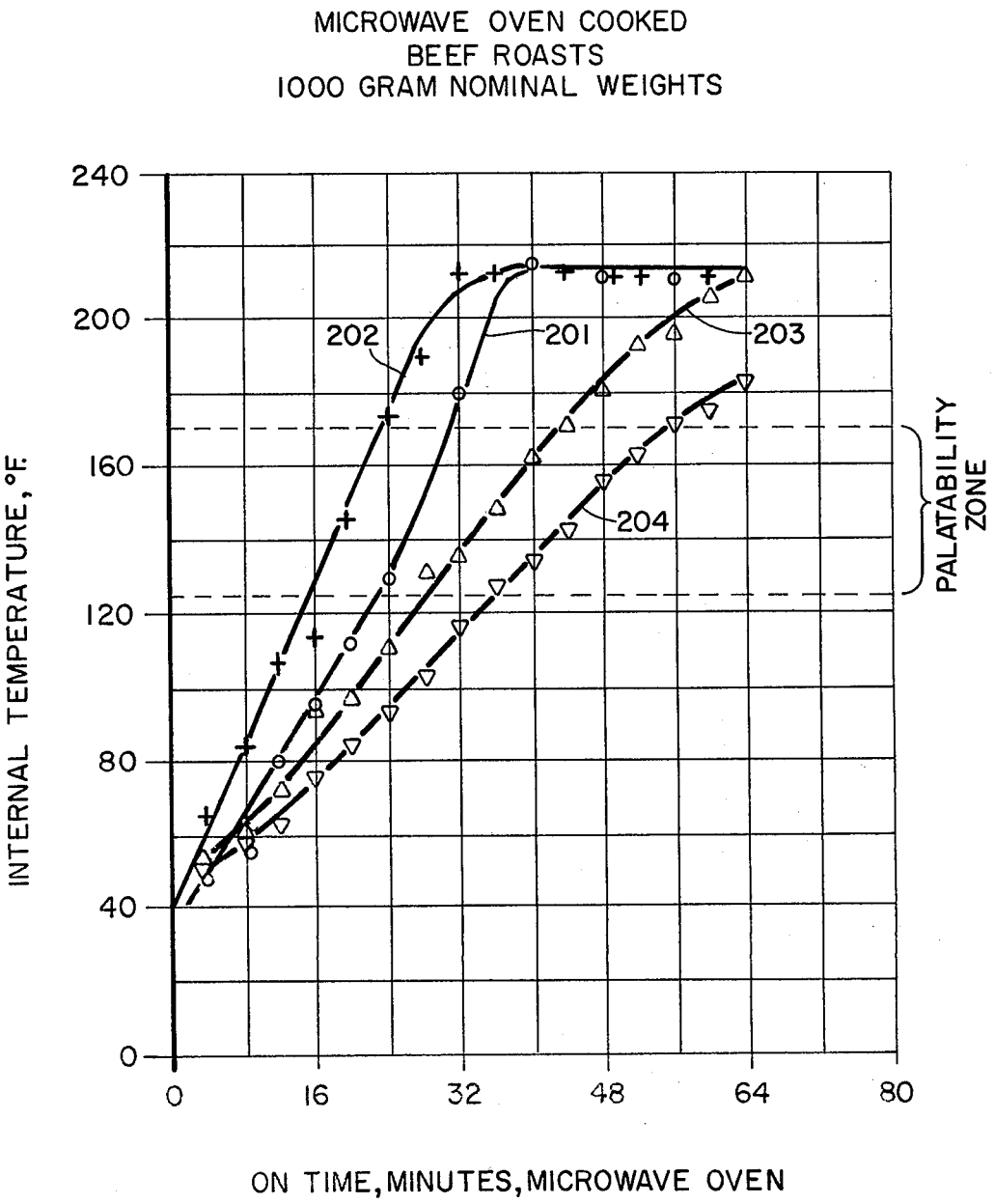
FIGS. 24 through 32 are graphs pertaining to the performance and theory of the present invention.

More specifically, FIG. 24 is a graph showing the time vs internal temperature relations among roasts which were: not wrapped, Example Series No. 1, curve 201; enclosed in oven bags, Example Series No. 4, curve 202; loosely wrapped (pouched) in a three ply static embodiment (FIG. 2) of the present invention, Example Series No. 11, curve 203; and loosely wrapped (pouched) in a dynamic (heat shrinkable) three ply embodiment (FIG. 2) of the present invention, Example Series No. 15, curve 204.

Briefly, the curves on the graph, FIG. 24, show that both the static (curve 203) and dynamic (curve 204), wrap embodiments of the invention, FIG. 2, cook more slowly than unwrapped roasts (curve 201) and the oven bag enclosed roasts (curve 202). This extra time, especially in the palatability zone, facilitates achieving a predetermined degree of doneness through the use of the invention than without it. That is, the roast can be periodically checked with, for instance, a meat thermometer at less critically timed intervals through the use of the present invention. Moreover, as discussed hereinbefore, the cessation of shrinkage of the dynamic embodiments provides a visually perceivable manifestation of a predetermined degree of doneness without the use of a meat thermometer and/or a temperature (end point) control system.

Figure 25:
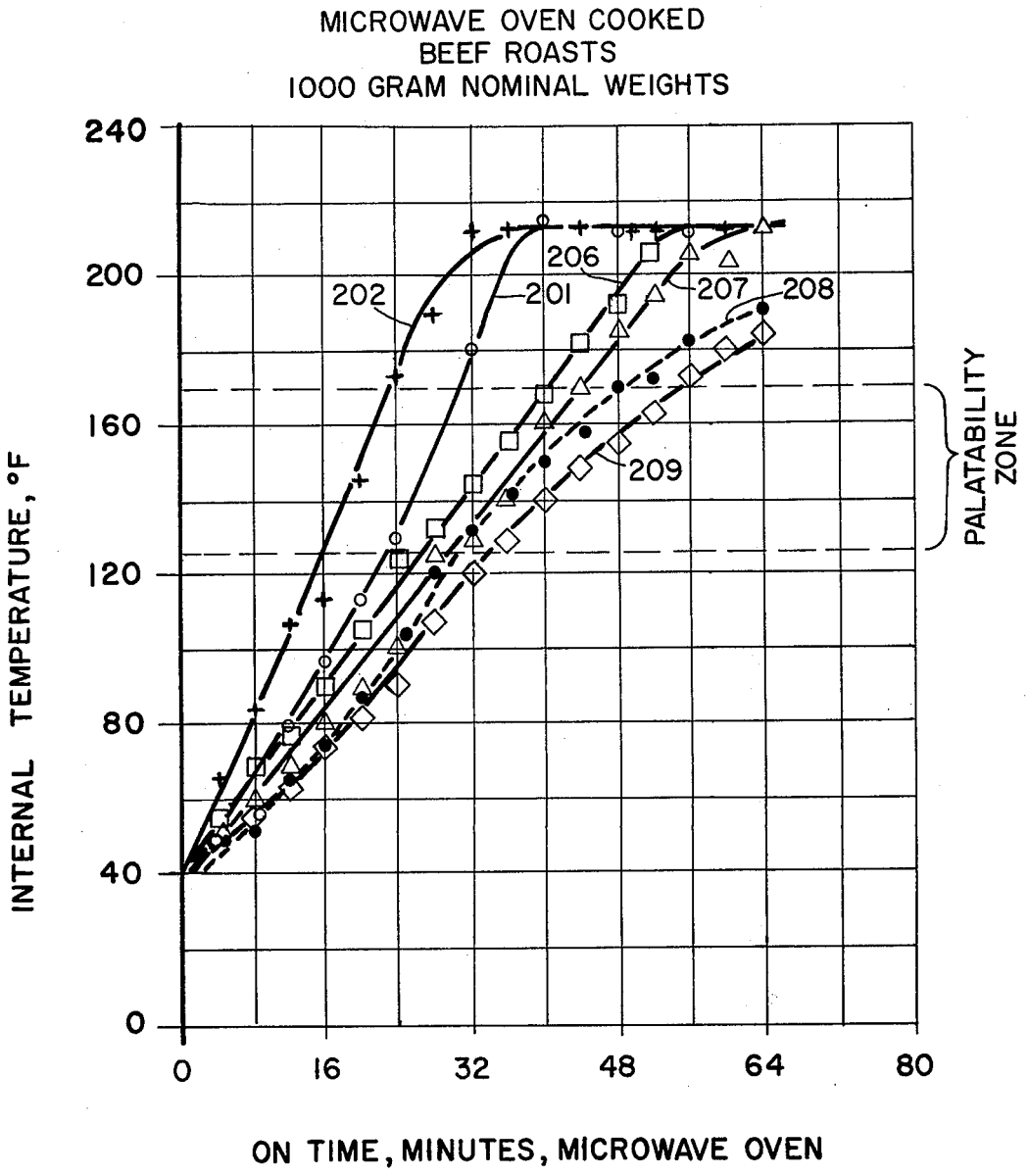

FIG. 25 is a graph showing time vs. internal temperature of roasts which were cooked using a variety of static embodiments of the present invention. Curves 201, (no-wrap) and 202 (oven bag) are repeated to facilitate comparisons. Curves 206 through 209 resulted from tests involving the following static embodiments of the present invention: curve 206, 2 ply embodiment of Series 9; curve 207, 3 ply wrap 140 of Series 10; curve 208, loosely fitted foil of Series 6; and curve 209, closely fitted foil only of Series 7.

Figure 26:
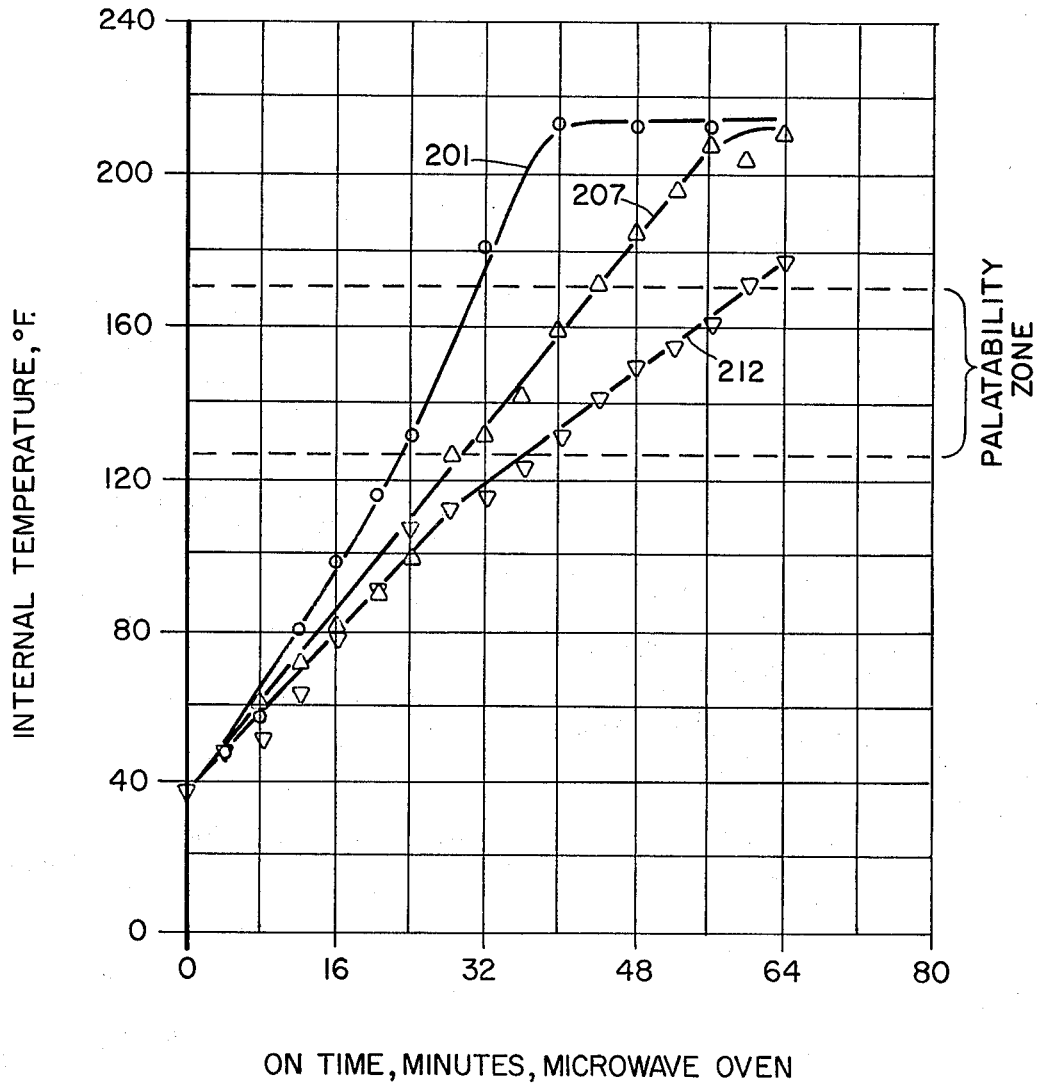

FIG. 26 shows curves 201, 207 and 212 which involved, respectively: no-wrap; static three ply wrap 140, FIG. 6, Series 10; and dynamic three ply wrap 140, FIG. 6, Series 14.

The performance of both static and dynamic wrap 40, FIG. 2, can be compared to the performance of static and dynamic wraps 140, FIG. 6, by comparing curves 203 and 204 of FIG. 24 with curves 207 and 212 of FIG. 26. As stated hereinbefore, the delta-shape array of apertures of wrap 40 provides a faster cooking rate than wrap 140 and uses about twelve percent (12%) less aluminum; a significant benefit with respect to the conservation of materials.

Figure 27:
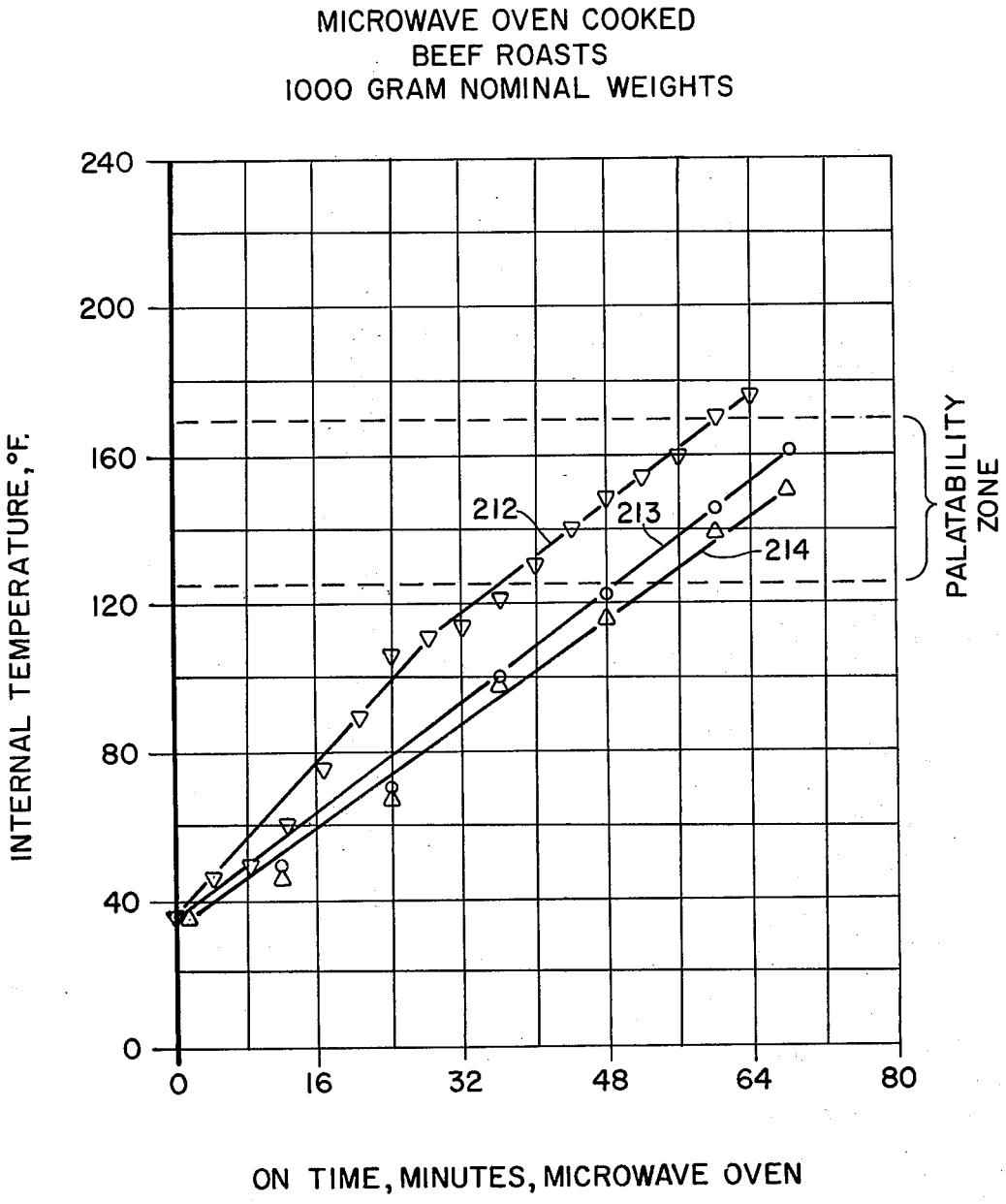

FIG. 27 is a graph which shows the time vs temperature relations among roasts which were cooked as follows: curve 212 was developed through the use of a dynamic wrap 140, FIG. 6, Series 14; curve 213 was developed through the use of a dynamic wrap 140 which had been pre-shrunk with hot air to approximate its ultimate degree of closure prior to beginning the cooking of that particular roast; and curve 214 was developed through the re-use of a dynamic wrap 140, FIG. 6, Series 14. These curves illustrate the reduced rate of cooking which is precipitated by the shrinkage of the dynamic embodiments of the invention. Because curves 212 through 214 have approximately equal slopes through the palatability zone, each would provide about equal criticality of timing through the palatability zone but, because the dynamic cooks faster and provides substantial benefits (Series 10, Tables I through IV), it is believed to be obviously superior to pre-shrunken wraps and/or to similar wraps having smaller holes which are static (non-shrinking).

Figure 28:
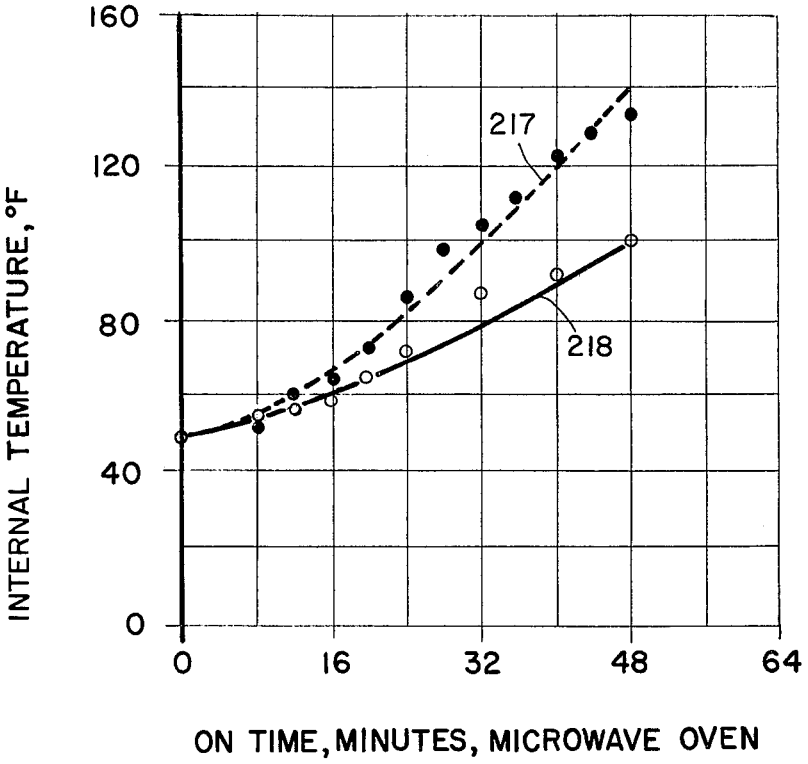

FIG. 28 is a graph which illustrates the criticality with respect to where vent/drain holes are positioned. Two 16×20 inch samples of dynamic wrap 140, FIG. 6, having a 14×18 orthogonal-shape array of apertures 44, were prepared wherein apertures 44 where five-eighth inch (about 16 mm) diameter and were spaced one inch (about 25.4 mm) between centers. Layers 41 and 42 were sixty (60) gauge, biaxially oriented polyethylene, and layer 43 was aluminum foil having a thickness of about thirty-five hundred-thousandths inch (about 0.009 mm). In one sample, one-quarter inch (about 6.35 mm) diameter vent/drain holes were centrally located in the thermoplastic spanning each of the two-hundred-fiftytwo (252) apertures 44. In the second sample, two-hundred-twenty-one (221) one-quarter-inch vent/drain holes were provided in the central portions of the cross-shape lands defined by each two-by-two sub-array of apertures 44.

These two samples were then used to form pouches about beef roasts which were then cooked in microwave ovens in the manner described hereinbefore: full power, and no repositioning. Curves 217 and 218 resulted from the samples having the vent/drain holes centrally located in the thermoplastic material spanning apertures 44, and the aforesaid lands, respectively. Thus, placing the vent/drain holes in the apertures does not impair the microwave transmissibility of wrap embodiments of the present invention as much as placing them in the aforesaid lands. This is inferred from curve 218 (vents in lands) indicating a much slower heating (cooking) rate than curve 217 (vents in apertures 44) notwithstanding the fact that the two-hundred-twenty-one (221) one-quarter inch (6.35 mm) diameter vent/-drain holes in the lands cumulatively provide an additional ten-and-eight-tenths (10.8) square inches of unshielded area as compared to placing the vent/drain holes through the thermoplastic spanning apertures 44. That is, less shielding precipitated slower cooking; a completely unexpected phenomenon.

MICROWAVE OVEN WATER HEATING TESTS

Referring now to FIGS. 29 through 32, they are graphs showing time vs. temperature rise relations which illustrate the effects of varying some of the parameters of the present invention. Briefly, FIGS. 29 through 32 were derived by placing forty (40) milliliters of water in a microwave transparent inner container inside an internally insulated, cubical-shape (having six inch square sides), microwave reflective quasi-calorimeter having a five inch (about 12.7 mm.) square opening in its top wall. The calorimeter was then provided with a variety of six inch (about 15.2 mm.) square, microwave moderator tops of microwave reflective material which each had a sub-array of nine (9) holes through it. The variety of tops resulted in generating curves 221 and 222, FIG. 29; curves 224 through 228, FIG. 30; curves 231 through 235, FIG. 31; and curves 237 through 239, FIG. 32.

Figure 29:
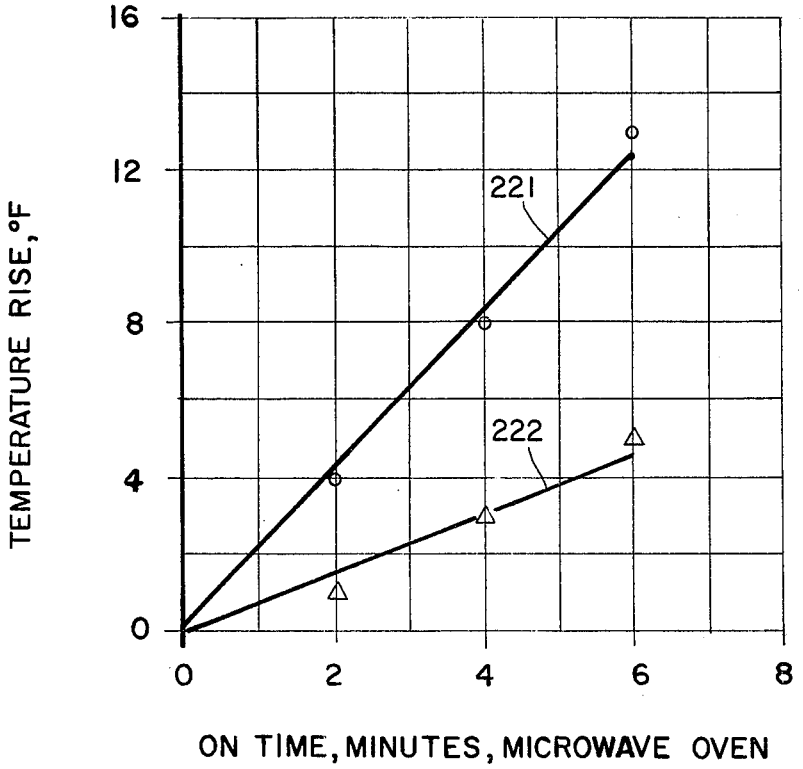

Briefly, FIG. 29 illustrates the relative microwave energy (2.45 GHz) transmissibility difference between a moderator top comprising a nine-aperture portion of static wrap 140, Example Series No. 10, curve 221, and a moderator top comprising a nine-aperture portion of an activated (shrunken) dynamic wrap 140, Example Series No. 14, curve 222.

Figure 30:
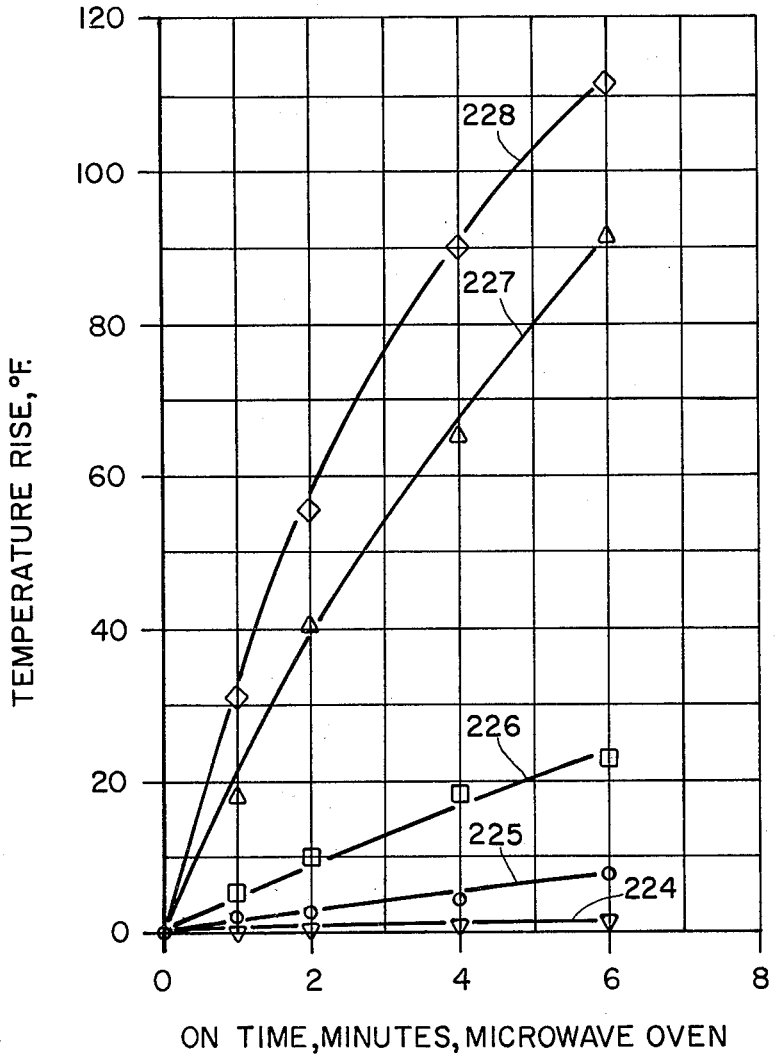

FIG. 30 illustrates that the relative microwave energy transmissibility of such microwave moderators is directly related to the diameter of the holes when the spacing between holes is constant. The calorimeter-top moderators used to generate the curves of FIG. 30 comprised nine-hole delta-shape aperture sub-arrays in which the holes were spaced one-quarter inch (about 6.35 mm) apart and in which the holes had, with respect to curves 224 through 228, diameters of one-quarter-inch (about 6.35 mm), three-eighths-inch (about 9.5 mm), one-half-inch (about 12.7 mm), three-quarters-inch (about 19 mm), and one inch (25.4 mm), respectively.

Figure 31:
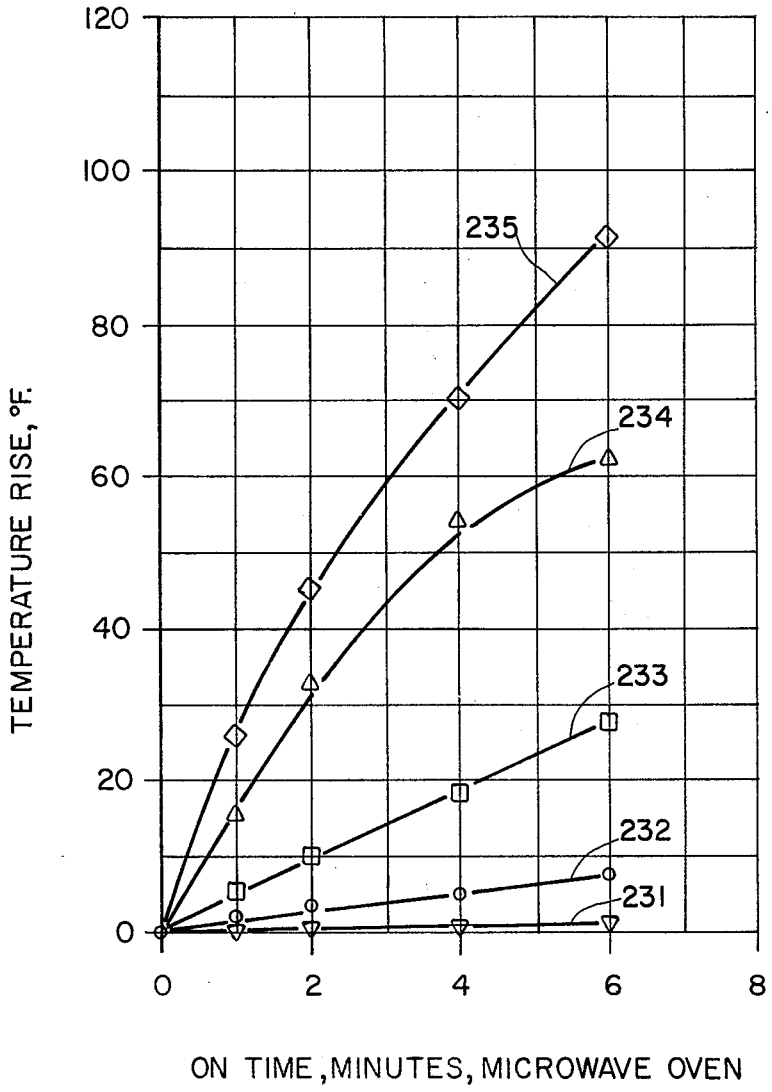

FIG. 31 is a graph of data which were generated in the same manner as for FIG. 30 except that the nine-hole sub-arrays of apertures were delta-shape (FIG. 2) for FIG. 30, and were orthogonal-shape (FIG. 6) for FIG. 31. Curves 231 through 235 were generated using moderators having hole diameters of one-quarter-inch (about 6.35 mm), three-eighths-inch (about 9.5 mm), one-half-inch (about 12.7 mm), three-quarters-inch (about 19 mm), and one-inch (25.4 mm), respectively. Comparing the curves of FIG. 31 with the corresponding curves of FIG. 30 confirms that the delta-shape array provides greater microwave transmissibility (higher heating rates) than the orthogonal-shape array; all other things being equal.

Figure 32:
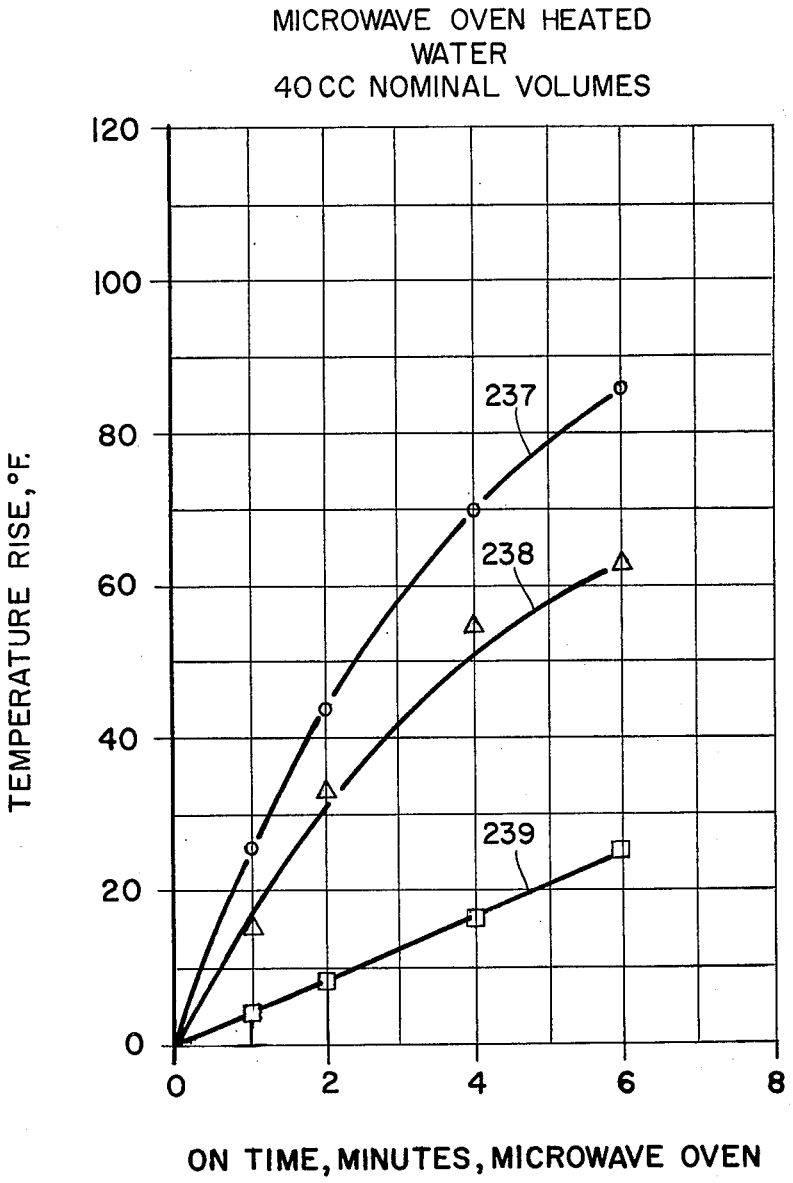

Referring now to FIG. 32, curves 237 through 239 illustrate the effect of varying the inter-hole spacing in fixed arrays of holes of a given diameter, to wit: the apparent relative microwave energy transmissibility of a calorimeter-top type microwave moderator having a fixed number (nine in the example) of holes of a given diameter varies inversely with respect to the spacing of the holes. For curves 237 through 239, the six-by-six inch moderators had nine hole, orthogonal-shape sub-arrays of three-quarter-inch (about 19 mm) diameters and were spaced, center-to-center, seven-eighths-inch (about 22.2 mm), one-inch (25.4 mm), and one-and-one-half-inch (38.1 mm), respectively.

To summarize, FIG. 29 illustrates the effectiveness of dynamic microwave energy moderators such as wrap 140, FIG. 6, to reduce the rate of cooking from an initially high rate (curve 221) to a substantially diminished rate (curve 222) as the temperature is increased through the indicated range of temperature. FIGS. 30 through 32 show that relative microwave energy transmissibility of such moderators is directly related to hole diameter and inversely related to hole spacing. This is confirmed by the fact that, on the average, apertures 44 are more closely spaced in the delta-shape array (FIG. 2) than in the orthogonal-shape array (FIG. 6), and the evidence discussed hereinbefore that cooking is faster with embodiments of the invention having delta-shape aperture arrays as compared to orthogonal-shape aperture arrays.

While several embodiments of the present invention have been described herein, many other modifications of the above invention may be devised and used and it is not intended to hereby limit it to the embodiments shown or described. The terms used in describing the invention are used in their descriptive sense and not as terms of limitation, it being intended that all of the equivalents thereof be included within the scope of the appended claims.

What is claimed is:

1. A microwave energy moderator comprising structure which is initially macroscopically relatively transparent to microwave energy of a predetermined frequency range, said moderator further comprising means for undergoing a sufficient structural transition that it will become substantially less transparent to said microwave energy as the temperature of said means is increased through a predetermined range of temperature.

2. The microwave energy moderator of claim 1 wherein said means comprises a first layer of heat shrinkable thermoplastic material which is substantially transparent to said microwave energy, a sheet of microwave reflective material having an aperture through it, and means for securing said layer to said sheet in face-to-face relation, said aperture being sufficiently large that it has a relatively high degree of transmissibility with respect to said microwave energy, said layer having a relatively great latent shrink capacity with respect to the size of said aperture and to the forces required to crumple said sheet, and said means for securing comprising means for causing shrinkage of said layer to effect sufficient crumpling of said sheet when the temperature of said moderator is increased through said predetermined temperature that the effective size of said aperture is so diminished that the relative transmissibility of said microwave energy therethrough is substantially reduced.

3. The microwave energy moderator of claim 2 further comprising a second layer of material which is substantially microwave transparent, said second layer being disposed in face-to-face relation with the second surface of said sheet of microwave reflective material so that said sheet is disposed intermediate said first layer and said second layer, and so that said moderator comprises a three ply structure.

4. The microwave energy moderator of claim 3 wherein said second layer comprises said heat shrinkable thermoplastic material, and wherein said means for securing said second layer further enables said moderator to sufficiently shrink and crumple when the temperature of said moderator is increased through said predetermined range of temperature to substantially reduce the transmissibility of said microwave energy through said moderator.

5. The microwave energy moderator of claim 1 further comprising a first layer of heat shrinkable thermoplastic material which is substantially transparent to said microwave energy, and a plurality of spaced microwave reflectors, each of said reflectors being secured to said first layer at only a relatively small area, said reflectors being so disposed, configured, and initially spaced that said moderator is initially relatively transparent to said microwave energy, said heat shrinkable material having a sufficiently great degree of latent shrink capacity that, when the temperature of said moderator is increased through said predetermined range of temperature, said reflectors will become sufficiently closely spaced that the relative transmissibility of said microwave energy through said moderator will be substantially reduced.

6. The microwave energy moderator of claim 5 wherein said moderator further comprises means for substantially obviating electrical arcing when said moderator is disposed in a field of said microwave energy.

7. A microwave energy moderating wrap for enclosing an article to be heated in a field of microwave energy of a predetermined frequency range, said wrap comprising a sheet of microwave reflective material which sheet is substantially fully comprised of a predetermined array of alternately disposed portions of microwave reflective material and complemental-shape zones which zones are substantially transparent to microwave energy of said predetermined frequency range, said sheet being substantially fully perforated by a multiplicity of spaced apertures, said microwave reflective portions being portions of said sheet of microwave reflective material, and said zones being said apertures, said wrap further comprising means for providing said wrap with predetermined degrees of vapor and liquid permeability through said zones which are substantially transparent to said microwave energy.

8. A microwave energy moderating wrap for enclosing an article to be heated in a field of microwave energy of a predetermined frequency range, said wrap comprising a sheet of microwave reflective material which sheet is substantially fully comprised of a predetermined array of alternately disposed portions of microwave reflective material and complemental-shape zones which zones are substantially transparent to microwave energy of said predetermined frequency range, said sheet being substantially fully perforated by a multiplicity of spaced apertures, said microwave reflective portions being portions of said sheet of microwave reflective material, and said zones being said apertures, said wrap further comprising means for undergoing a sufficient structural transition that it will become substantially less transparent to microwave energy of said predetermined frequency range as the temperature of said means is increased through a predetermined range of temperature.

9. The microwave energy moderating wrap of claim 8 wherein said means for undergoing said transition comprises a first layer of heat shrinkable thermoplastic material which is substantially transparent to said microwave energy, and means for securing said layer to said sheet in face-to-face relation so that zones of said layer span said apertures and are said zones which are substantially transparent to said microwave energy, said layer of thermoplastic material having a sufficiently great degree of latent shrink capacity with respect to the forces required to crumple said sheet and with respect to said means for securing that, when the temperature of said wrap is increased through said predetermined range of temperature, said layer will shrink and said foil will crumple sufficiently to so reduce the effective sizes of said apertures that the transmissibility of said microwave energy therethrough is substantially reduced.

10. The microwave energy moderating wrap of claim 9 which further comprises means for providing said wrap with predetermined degrees of vapor and liquid permeability through said zones which are substantially transparent to said microwave energy.

11. The microwave energy moderating wrap of claim 9 wherein said first layer is sufficiently foraminous in its portions which span said apertures to provide said wrap with predetermined degrees of vapor and liquid permeability.

12. The microwave energy moderating wrap of claim 9 wherein said wrap has sufficient shrink capacity to reduce the ratio of the major dimension of said apertures to the wavelength of said microwave energy to less than about twenty-three to one hundred (23:100).

13. The microwave energy moderating wrap of claim 12 wherein said wrap has sufficient shrink capacity to reduce said ratio to less than about sixteen to one hundred (16:100).

14. The microwave energy moderating wrap of claim 9 further comprising a second layer of material which is substantially microwave transparent, said second layer being disposed in face-to-face relation with the second surface of said sheet of microwave reflective material to that said sheet is disposed intermediate said first layer and said second layer, and so that said wrap comprises a three ply structure.

15. The microwave energy moderating wrap of claim 14 wherein both said first layer and said second layer comprise electrical insulation materials and wherein the edge portion of said layers extend beyond adjacent edge portions of said sheet and are bonded together in face-to-face relation whereby said edge portions of said sheet are electrically insulated and arcing in a microwave field is substantially obviated.

16. The microwave energy moderator of claim 14 wherein both said layers are sufficiently foraminous in their portions which span said apertures to provide said wrap with predetermined degrees of moisture and liquid permeability.

17. A microwave energy moderating enclosure for an article to be heated in a field of microwave energy of a predetermined frequency range, said enclosure comprising means for placing a said article therein and removing said article therefrom, and an exterior wall which is substantially fully comprised of a predetermined array of alternately disposed portions of microwave reflective material and complemental-shape zones which zones are substantially transparent to microwave energy of said predetermined frequency range, said exterior wall being configured to initially be macroscopically relatively transparent to said microwave energy and further comprising means for undergoing a sufficient structural transition that it will become substantially less transparent to said microwave energy as the temperature of said enclosure is increased through a predetermined range of temperature.

18. The microwave energy moderating enclosure of claim 17 wherein said means for undergoing a sufficient structural transition comprises heat shrinkable thermoplastic material.

19. A microwave energy moderating closeable bag for an article to be heated in a field of microwave energy of a predetermined frequency range, said bag comprising closure means for enabling enclosing a said article therein and removing said article therefrom, and an exterior wall which is substantially fully comprised of a predetermined array of alternately disposed portions of microwave reflective material and complemental-shape zones which zones are substantially transparent to microwave energy of said predetermined frequency range, said bag further comprising means for said bag to undergo a sufficient structural transition that it will become substantially less transparent to said microwave energy as the temperature of said bag is increased through a predetermined range of temperature.

20. The microwave energy moderating bag of claim 19 comprising a sheet of microwave reflective material which is substantially fully perforated by a multiplicity of spaced apertures, said microwave reflective portions being portions of said sheet of microwave reflective material, and said zones being said apertures.

21. The microwave energy moderating bag of claim 19 further comprising a first layer of heat shrinkable thermoplastic material which is substantially transparent to said microwave energy, and a plurality of spaced microwave reflectors, each of said reflectors having only a relatively small area secured to said first layer, said reflectors being so disposed and configured that said reflectors are said portions of microwave reflective material, and the zones of said first layer disposed intermediate said reflectors being said zones which are substantially transparent to microwave energy of a predetermined frequency range, said reflectors being initially spaced sufficiently that said enclosure is initially relatively transparent to said microwave energy, said heat shrinkable material having a sufficiently great degree of latent shrink capacity that, when the temperature of said enclosure is increased through said predetermined range of temperature said reflectors will become sufficiently closely spaced that the relative transmissibility of said microwave energy through said zones will be substantially reduced.

22. A microwave energy moderating package for comestible matter to be heated in a field of microwave energy of a predetermined frequency range which package comprises a microwave moderating enclosure, a quantity of said comestible matter, and means for providing a predetermined degree of vapor and liquid permeability said enclosure comprising an exterior wall which is substantially fully comprised of a predetermined array of alternatively disposed portions of microwave reflective material and complemental-shape zones which zones are substantially transparent to microwave energy of said predetermined frequency range, the remainder of said exterior wall of said enclosure being comprised of microwave reflective material, said package comprising means for undergoing a sufficient structural transition that it will become substantially less transparent to said microwave energy as the temperature of said package is increased through a predetermined range of temperature.

23. The microwave energy moderating package of claim 22 wherein said means for undergoing said transition comprises heat shrinkable thermoplastic material.

24. The microwave energy moderating package of claim 23 wherein said heat shrinkable thermoplastic material is biaxially oriented.

* * * * *